US007658214B2

(12) United States Patent
McDaniel

(10) Patent No.: US 7,658,214 B2
(45) Date of Patent: Feb. 9, 2010

(54) DUST COLLECTION CHUTE FOR A JIG APPARATUS

(75) Inventor: Steven D. McDaniel, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/268,091

(22) Filed: Nov. 10, 2008

(65) Prior Publication Data

US 2009/0056832 A1 Mar. 5, 2009

Related U.S. Application Data

(63) Continuation of application No. 11/186,408, filed on Jul. 21, 2005, now Pat. No. 7,455,089.

(60) Provisional application No. 60/592,734, filed on Jul. 30, 2004, provisional application No. 60/664,053, filed on Mar. 22, 2005.

(51) Int. Cl.
*B27C 5/00* (2006.01)
*B27G 21/00* (2006.01)

(52) U.S. Cl. ..... 144/144.1; 144/145.1; 144/252.1; 409/130

(58) Field of Classification Search ..... 144/85, 144/87, 144.51, 145.1, 252.1, 252.2; 409/12, 409/130, 137, 125; 408/67; 83/100; 451/451, 451/456

See application file for complete search history.

(56) References Cited

U.S. PATENT DOCUMENTS 3,232,327 A * 2/1966 Baranczyk ..... 144/85
7,434,604 B2 * 10/2008 McDaniel et al. ..... 144/48.5
7,455,089 B2 * 11/2008 McDaniel et al. ..... 144/144.1

* cited by examiner

*Primary Examiner*—Shelley Self

(57) ABSTRACT

A jig apparatus for aiding in the formation of a variety of mechanically interconnecting structures in workpieces. The jig apparatus may include a base and a template mounting system for adjustably positioning a template with respect to the base. A securing system for securing a work piece in a desired position may be included. An adjustable workpiece mounting fence may also be included for varying the angular orientation of a workpiece to be shaped with respect to a template. Additionally, a collar guide system for a router for utilization with a template may be implemented with a hand held router being implemented for removing material from a workpiece. A router bit positioning system for aiding in establishing a pre-determined bit depth may be included.

21 Claims, 25 Drawing Sheets

DUST COLLECTION CHUTE FOR A JIG APPARATUS

CROSS REFERENCE

The present application is a continuation of U.S. patent application Ser. No. 11/186,408, filed Jul. 21, 2005, now U.S. Pat. No. 7,455,089, which application claims priority under 35 U.S.C. §119(e) to U.S. Provisional Patent Application Ser. No. 60/592,734, filed on Jul. 30, 2004, and to U.S. Provisional Patent Application Ser. No. 60/664,053, filed on Mar. 22, 2005. Each previous application is hereby incorporated by reference in its entirety.

FIELD OF THE INVENTION

The present invention generally relates to the field of woodworking and more particularly to joinery.

BACKGROUND OF THE INVENTION

The ability of a craftsperson to form fine joinery such as cabinetry is often the true measure of the person's woodworking skill. Poorly fitting joints may detract from the overall projects aesthetics and functionality, especially for fine cabinetry. Proper fit and assembly often require a high level of skill or a large time commitment on behalf of a novice woodworker. To aid in the process, a woodworker will often employ a jig or form to assist in proper joint formation. Too often these jigs tend to be complex to set-up for use, difficult to understand how adjustments impact the finished workpiece, and lack efficient methods for reestablishing commonly made joinery, such as dovetails, box joints, and mortise and tenon joints. Novice woodworkers may even tend to avoid forming fine joinery, instead selecting a simpler joint such as a butt-joint rather than attempt to implement a complex or non-intuitive jig. Expert woodworkers, in contrast, may become frustrated with the set-up lime required for the jig device. The effectiveness of a jig may be judged on the ability of a user to rapidly set the jig for the desired joint in an intuitive manner.

Typical jig devices may lack the ability to form a wide variety of joints. As a result, a woodworker may have to obtain a different device in order to make a desired joint. For example, a user may own a jig for making drawers and an entirely separate jig for aiding in formation of a mortise and tenon joint to assemble a table leg and rail. In addition to the expense, these devices may consume valuable workshop space.

While some devices permit the formation of various types of joinery such as through dovetails, half-blind dovetails of various fixed spacings, and box joints, a user may tend to accept a lesser quality joint due to set-up errors, or be required to conduct test cuts to ensure the desired fit is obtained, for example, if a router bit does not extend sufficiently, below the template, into a workpiece the resultant assembled workpiece, such as two sides of a drawer joined by a half-blind dovetail, may have a loose joint. Correspondingly, if the cutting bit extends too far into the workpiece the joint may be too tight. In either case, remedial action may be required for the pieces forming the assembled workpiece to meet user demands or another set of individual workpieces must be shaped. Other jig alignment issues may also affect the overall fit and finish of the resultant workpiece. Examples include the relative position of a template with respect to the workpiece. For instance, improper alignment of an end of a workpiece with respect to a template may result in a joint which is either loose or too tight.

In additional instances, some existing jigs fail to offer convenient workpiece positioning and securing, for example, when forming half-blind dovetails in a single pass (when both the pins and tails are formed in a single operation) the workpieces are off-set from each other, along the length of the joint, to account for the spacing between pins/tails so that the workpieces align in the desired fashion. To accomplish the foregoing in a ½" (one-half inch) half-blind dovetail, the workpieces are off-set along their width or a secondary axis of the board by a ½" (one-half inch) to ensure at least a partial pin is formed on either end of the workpiece or board. Once properly positioned, a workpiece is required to be firmly secured to prevent inadvertent movement during a shaping or cutting operation. Difficulties with some securing devices include the inability of the securing device to effectuate both coarse and fine adjustment in a convenient manner, for example, some securing devices may be difficult for the user to secure while properly positioning the workpiece.

Commonly, joined workpieces are typically secured at right angles to each other. If a non-perpendicular joint is desired, a woodworker may be forced to hand form the joint or purchase/construct a jig for accommodating the desired angle. Typically, such non-standard joints are only attempted by experienced woodworkers who demand devices having full features. For example, a triangular table having three legs connected via a rail adjacent the support surface requires that a mortise and tenon joint be formed with an acute angle. As a result, in order for a jig to be considered for purchase by a skilled woodworker, the jig should offer the capability to form non-standard angular joints.

In addition to the difficulties experienced in setting-up the jig, dust and debris generated by operation of a hand-held router removing material, from the work piece during shaping operations, may be problematic to remove or tend to get caught between the router sub-base plate and the fingers/template. This may require a user to halt operations to remove the dust and debris away from the working area before recommencing operations. This may slow overall progress and become an annoyance to the woodworker.

Therefore, it would be desirable to provide an apparatus configured for aiding efficient, intuitive joint formation without the drawbacks experienced in the prior art.

SUMMARY OF THE INVENTION

Accordingly, the present invention is directed to a jig apparatus for utilization in forming a variety of corresponding interconnecting structures for forming joinery between wooden workpieces.

In an aspect of the invention, a jig apparatus base having an intermediate one configured to minimize or prevent inadvertent contact between a bit and the base is disclosed. An intermediate zone is constructed in the base to provide a void adjacent a cutting interface of a router bit in a workpiece which is secured to the jig apparatus. Suitable constructions include angled or stepped interfaces between a first side of the base and a second side of the base. Additionally, a recess or void may be constructed in the base between the first and second sides for preventing inadvertent contact.

In an additional aspect of the invention, a template mounting system is discussed. In embodiments, suitable template mounting systems include opposing slotted brackets, included on a template, received by a threaded lock-down knob system. In further embodiments, a mounting bracket includes an elongate rail for receiving a template including an aperture or channel corresponding to the rail. A template mounting system in accordance with the present aspect may permit the utilization of a single template having multiple guides so as to provide increased versatility. The mounting system may allow for adjustable positioning with respect to a jig base having a first side and a second side orthogonally aligned to each other.

In a further aspect of the present invention, a visual alignment system may be included in the jig apparatus for assisting the user in proper alignment of the template with the workpiece/the base. In embodiments, a visual indicia or marker such as a scribed line may be included on a template, to be implemented with the jig apparatus, for providing a visual alignment for an edge of the workpiece/the abutment of workpieces to be shaped.

In another aspect of the present invention, a clamp assembly securing mechanism is disclosed. An exemplary clamp assembly may include a slideable mounting positioned on a threaded rod outwardly extending from the base. A threaded knob may be utilized to secure the mounting along the rod. A lock bar is pivotally coupled to the mounting. The lock bar may be formed or include an eccentric portion or cam portion for securing a workpiece disposed between the base and the lock bar. An engaging plate may be disposed between the lock bar and the workpiece in order to provide even application of force to the workpiece.

In a further aspect of the present invention, an adjustable angle workpiece mounting fence system may be included in the jig apparatus for permitting a user to vary the angular orientation of a workpiece with respect to a template. The main fence portion may be mounted via a pivotal trunnion coupling with spaced apart fence mounting brackets. A sliding auxiliary fence portion may be coupled to the main fence portion so a user may remove the auxiliary fence portion adjacent the template. Furthermore, a securing clamp may be coupled via a groove and rail system to the main fence portion for securing a workpiece to be shaped.

In an additional aspect of the present invention, a router bit positioning system is described. The router bit positioning system may promote efficient positioning of the depth of a router bit, or the extent to which a router bit extends beyond a router base/sub-basic. A bit slop may be mounted to the base, an extension included on the template, or a dedicated housing in-line with a slot or recess included in a support surface (e.g., a template). The bit stop may be fixed at a pre-selected depth commonly implemented to offset distance or allow for adjustment such as by utilizing a threaded rod, screw or the like.

In another aspect of the present invention, a variable spacing router collar system may be included for utilization varying the spacing or the distance between an included router bit and a guide or form being traced. A generally cylindrical collar body may be secured to a router base or sub-base via a threaded locking ring engaging threading included on an outer surface of the collar body. A kit or series of outer sleeves and/or collar bodies having differing outside diameters may be attached about a portion of the collar body through a magnetic interaction or an intermediate elastomeric O-ring to effectuate different spacings.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. It is to be appreciated that generally corresponding structures are provided with corresponding reference numbers. Additionally, while the present embodiments are directed generally to an apparatus in which a hand-held router is manipulated with respect to a fixed workpiece, the principles of the present invention may be equally applicable to an apparatus which is implemented with a fixed cutter such as in a router table, and the like devices for woodworking. It is the intention of this disclosure to encompass and include such variation.

Figure 1:
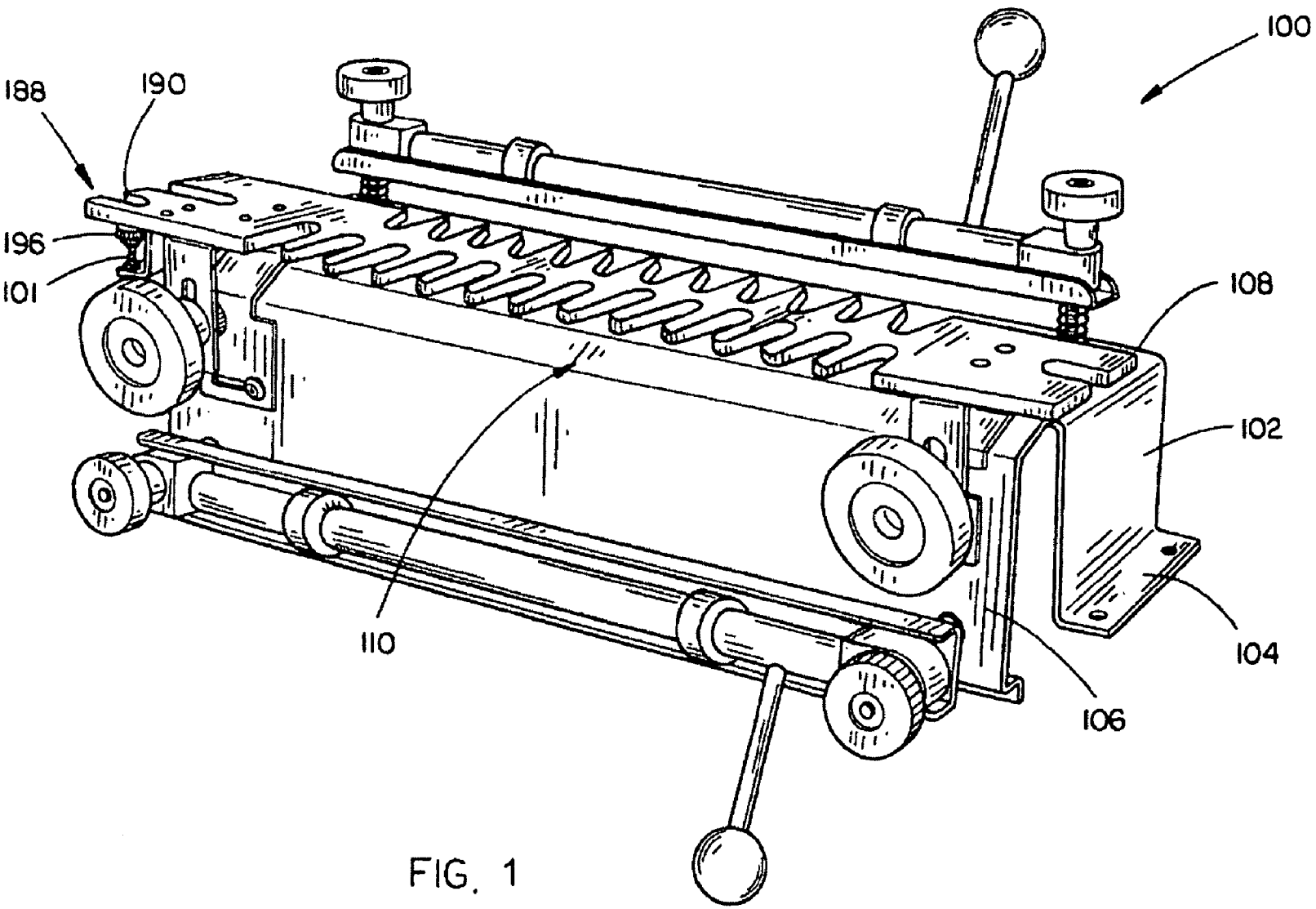
FIG. 1 is an isometric view of a jig apparatus in accordance with an aspect of the invention

Referring to FIG. 1, in the present embodiment of the invention, a jig apparatus 100 is discussed. The present apparatus 100 may be implemented to assist in forming a wide variety of joinery connections in an efficient manner.

Figure 2:
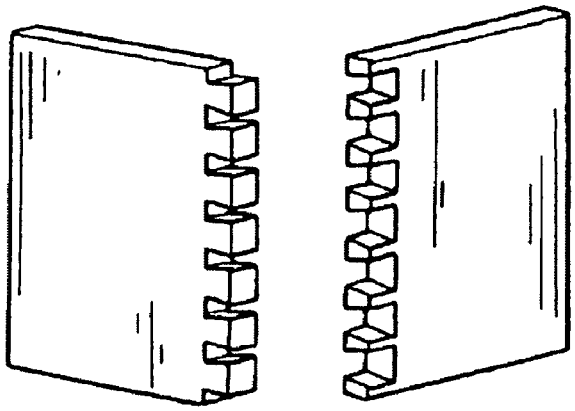
FIG. 2 is a general illustration of a resultant through dovetail joint formed in two workpieces.
Figure 3:
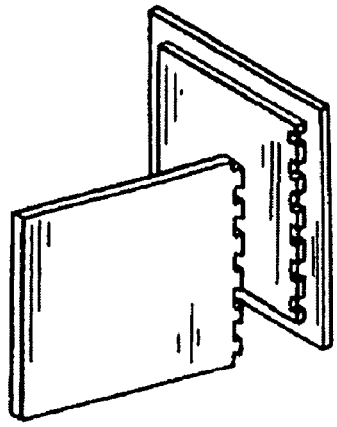
FIG. 3 is a general illustration of a resultant half-blind recessed dovetail joint formed in two workpieces.
Figure 4:
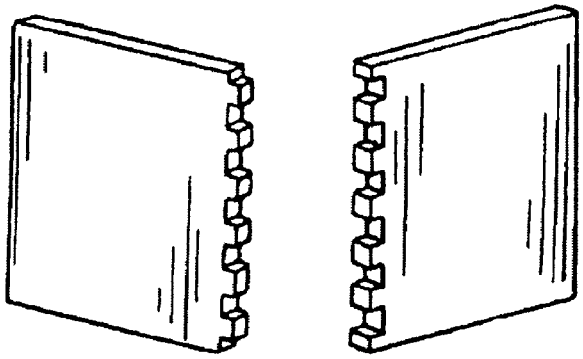
FIG. 4 is a general illustration of a resultant box joint formed in two workpieces.
Figure 5:
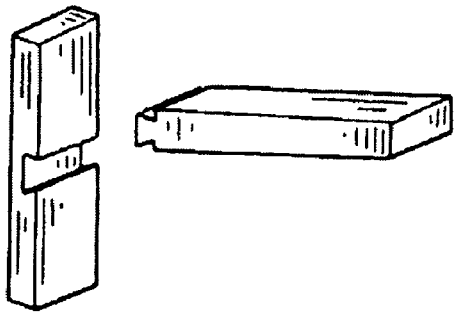
FIG. 5 is a general illustration of a resultant sliding tapered dovetail formed in two workpieces.
Figure 6:
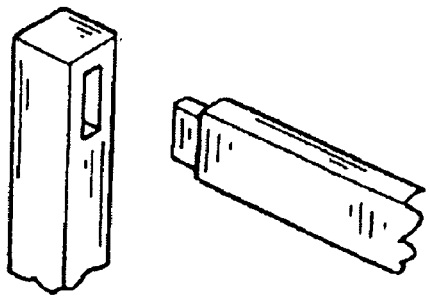
FIG. 6 is a general illustration of a resultant mortise and tenon joint formed in two workpieces.

Referring to FIGS. 2 through 6, while not inclusive, representative joints formed in workpieces include: FIG. 2 illustrating a typical through dovetail joint wherein the pins/tails (having linear angled sides) are observable along both sides of the connection; FIG. 3 illustrating a half-blind dovetail joint wherein the joint is generally observable from one side (in the present instance the half-blind dovetail is recessed towards the interior of one of the workpieces such as by rabbeting material from the edge of the workpiece); FIG. 4 illustrating a box joint wherein the pins/tails (having linear sides which are generally perpendicular to the end of the workpiece); FIG. 5 illustrating a sliding tapered dovetail wherein the tongue/groove include a generally trapezoidal shape; and FIG. 6 illustrating a mortise and tenon wherein the a generally rectilinear tongue is inserted into a blind generally rectilinear recess. Those of skill in the art will appreciate that the foregoing descriptions and the accompanying figures are only generally illustrative as some curvature may occur due to operation of a rotating bit generally following a template.

Referring again to FIG. 1, a base 102 is included in the jig apparatus 100. In the present example, the base 102 is formed by bending a sheet of metal having appropriate rigidity, durability, and the like into a generally rectangular configuration. Suitable materials include steel, aluminum based alloys, and the like. In further embodiments, the base may be formed from other materials such as plastics or cast metal, and the like having sufficient rigidity and durability. The base may include a flange 104 or the like for assisting in clamping or otherwise securing the jig apparatus 100, such as by utilizing a fastener, to attach the apparatus along an edge of a workbench or other suitable surface. In the current embodiment, a first side 106 of the base is substantially perpendicular to a second side 108 of the base for forming standard joinery.

Figure 13:
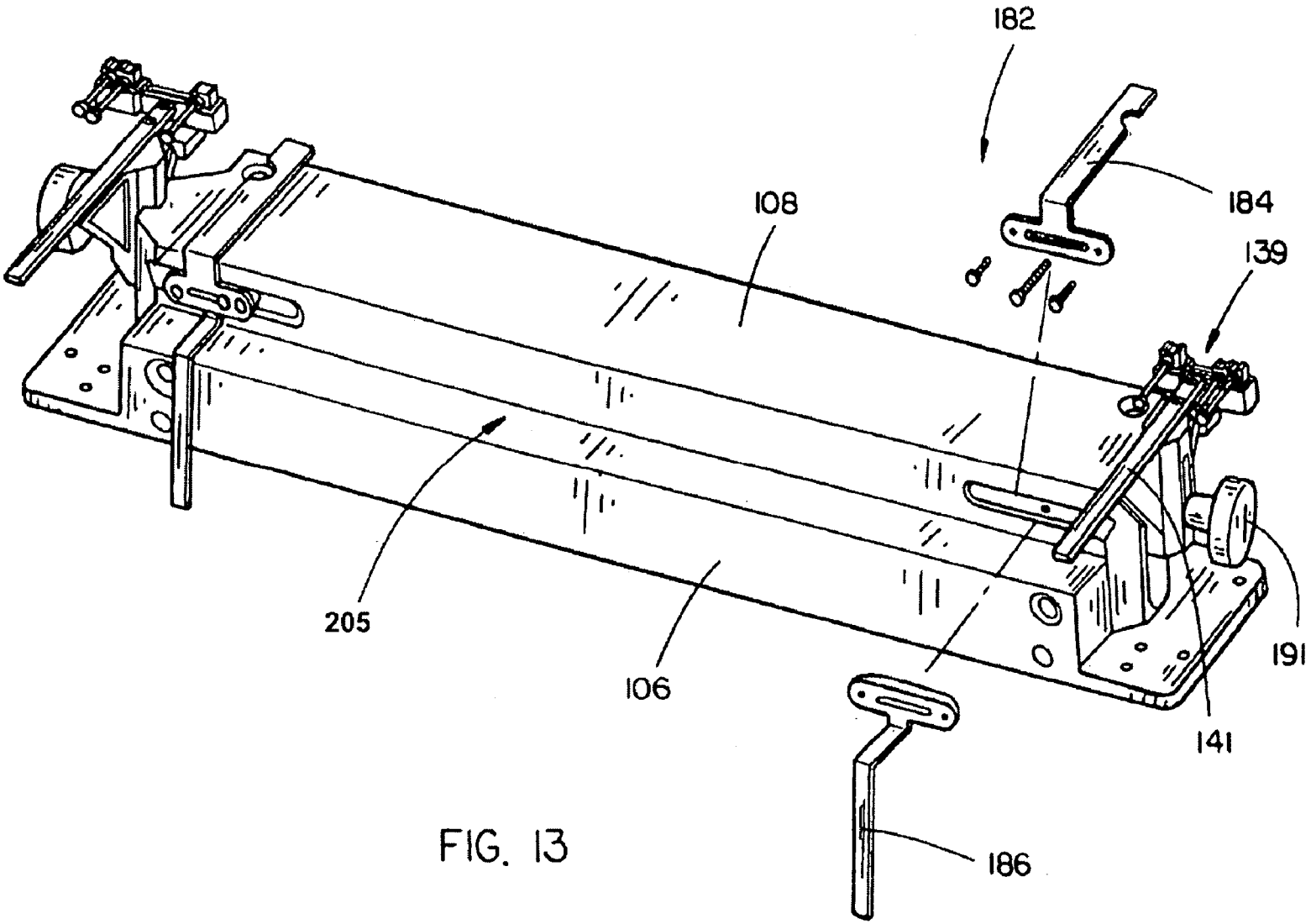
FIG. 13 is an isometric view of a jig apparatus illustrating an exemplary workpiece slop and a template mounting system in accordance with an additional aspect of the present invention.

Preferably, the interface between the first 106 and second 108 sides is angled 110 such that the first side and the second side do not meet in a right angle orientation. In further embodiments, such as illustrated in FIG. 13, the interface between the first side and the second side includes an intermediate stepped or recessed zone 205. Inclusion of an angled side 110 (FIG. 10) or a stepped zone 205 (FIG. 13) may minimize or prevent inadvertent contact between a cutter (e.g. a router bit) and the base 102 as a user manipulates the router relative to the base. Other configurations may be implemented as well, for example, a void or recess may be formed between the first and second side in order to provide a clearance space in the base adjacent an end of the workpiece.

Figure 7:
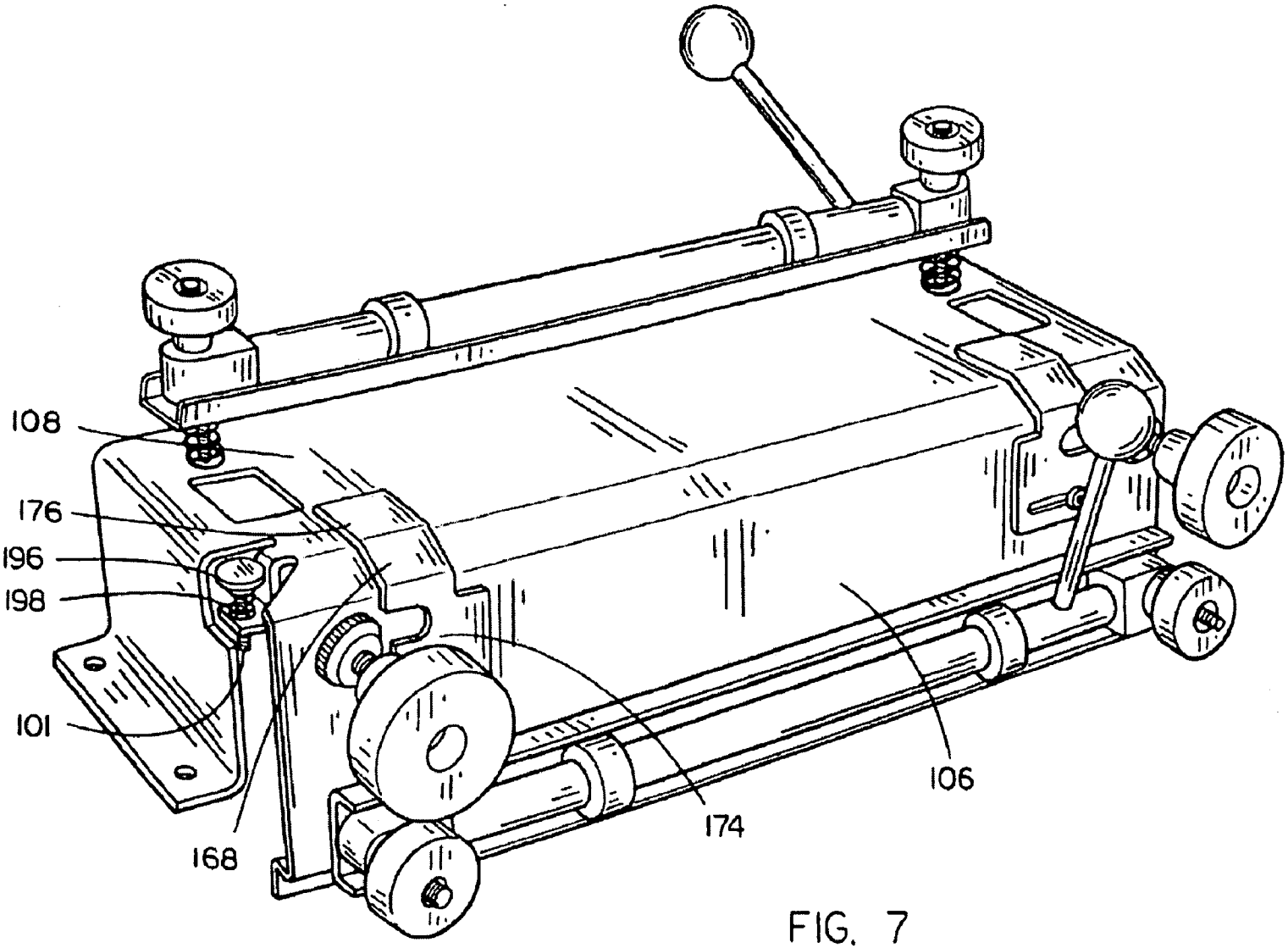
FIG. 7 is an isometric view of a jig apparatus of FIG. 1, wherein the template is not present.
Figure 8A:
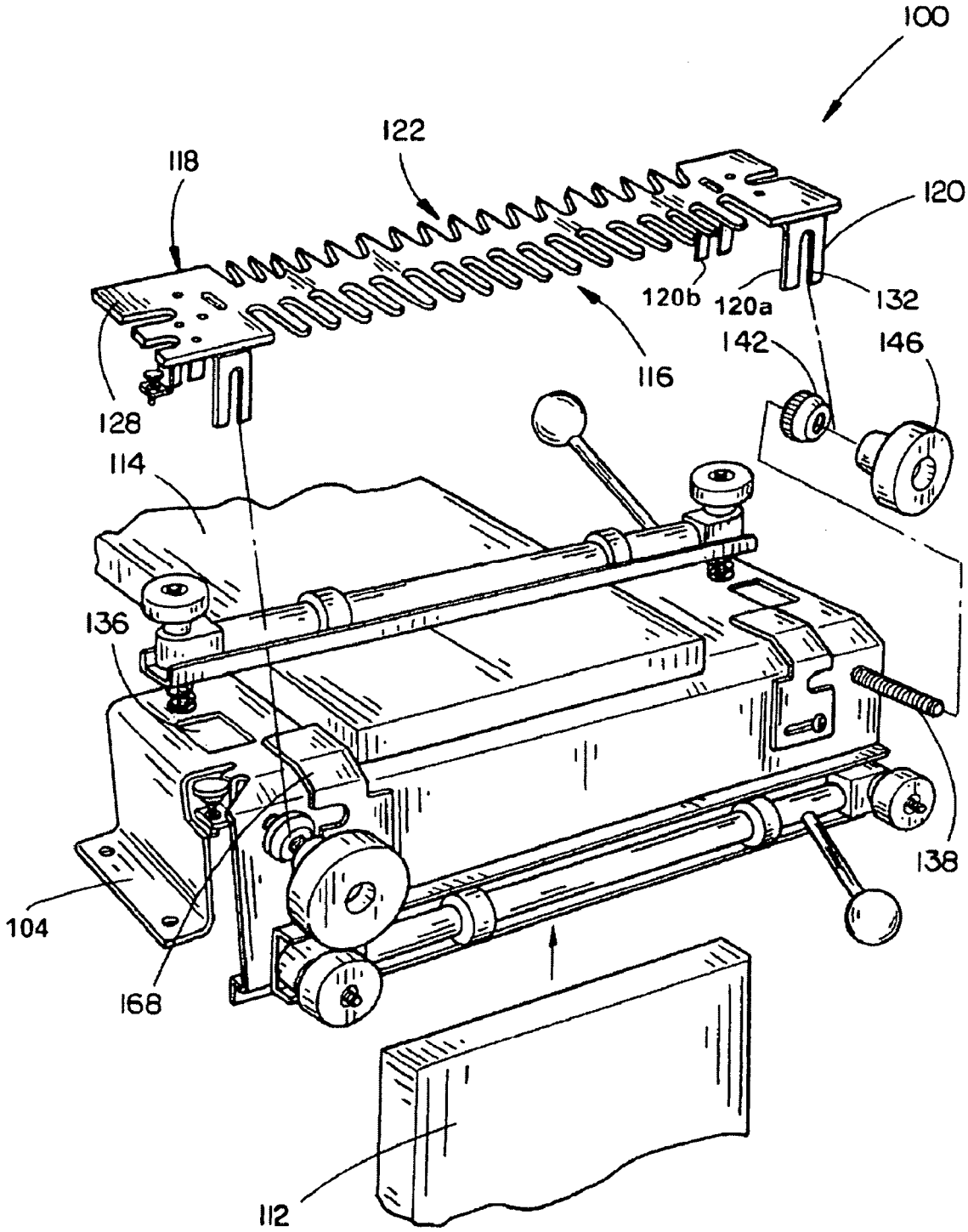
FIG. 8A is an exploded view of a jig apparatus of FIG. 1 further illustrating placement of example workpieces.
Figure 8B:
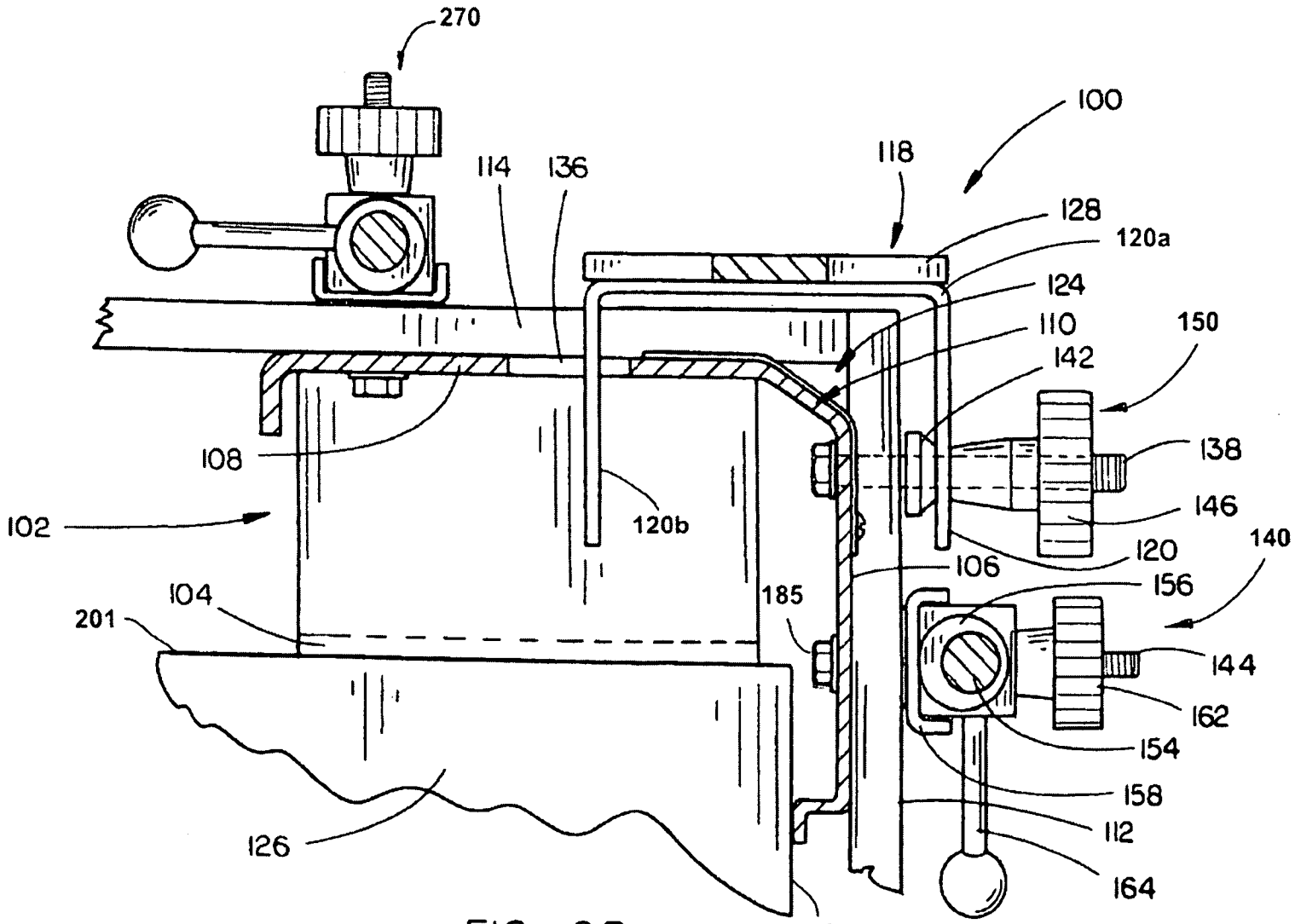
FIG. 8B is a cross-sectional view of a jig apparatus including example positioned workpieces.

For example, as may be generally observed in FIGS. 7, 8A, and 8B, when cutting a half-blind dovetail in a single pass, or performing a unitary operation, the two workpieces 112, 114 to be shaped are aligned on the jig apparatus. The first, vertical workpiece 112 is aligned with the first side 106, and the second, horizontal workpiece 114 is aligned with the second side 108. The respective ends of the workpieces 112, 114 are brought into abutment (as observed in FIG. 8B) typically with the edge of the first board 112 extending flush with the top surface of the second board 114. Inclusion of an angled side 110 defines a void 124 at the interface of the workpieces adjacent the first and second side of the base. In this fashion, as a router/router bit follows a guide 116 of a template 118, the router bit is unlikely to inadvertently contact the base 102. (The guide being one or more formations or extensions configured and designed to be generally traced by the operation of the router bit in the workpiece.) The void 124 or recess between the workpieces and the base may minimizes the likelihood that a router bit may contact the base such as if the router is lipped or angled with respect to the template during utilization. In another example, when cutting through dovetails an angled side 110 may prevent inadvertent contact between the router bit and the base 102 as the router bit may extend a distance beyond the thickness of the workpiece being formed.

With continued reference to FIGS. 7, 8A, and 8B, in a further example, the first side of the base 106 is formed to extend below the flange portion 104 and below the top surface 201 of the structure 126 supporting the jig 100. Extending the first side 106 beyond the support structure top surface 201 permits the first side 106 to contact an edge 203 of the support structure 126 thereby orientating the jig 100 on the support structure, minimizes movement of the jig on the support structure, and the like.

In the present embodiment, the base 102 is configured to implement a template 118 having multiple brackets 120 (one is referenced). Utilization of a multiple bracket system may permit reversal of the template or positioning a guide adjacent the first side 106, thereby increasing versatility of the template. For example, as illustrated in FIGS. 8A, 8B, 9, and 10, the template 118 includes a first guide 116 for forming a tail of a through dovetail (additionally this guide may be utilized for a hall-blind dovetail and a box joint as well) and a second guide 122 for forming through dovetail pins. The through dovetail pin guide having generally angular sides of the individual extensions. In the present example, two opposing brackets 120*a*, 120*b* are unitarily formed as a generally U-shape attachment fastened to the main body 128 of the template 118. Each of the brackets 120 includes a terminal end slot 132 for mounting on an outwardly extending threaded rod 138 (one is referenced), when in use. Those of skill in the art will appreciate the brackets may be formed individually and separately connected to the main body, integrally formed with the main body 128 (e.g., by bending the brackets generally perpendicular to the main body 128), and the like. The brackets 120*b* not being used to secure the template 118 to the base 102 may be received in a recess or aperture 136 (one is reference) formed in the base 102 to permit adjustment of the template toward/away the first side 106 (as indicated by arrow 148) and up/down relative to the second side 108 (as indicated by arrow 183). Two recesses/apertures 136 are included to prevent the unused brackets 120*b* from interfering with operation of the jig.

Referring to FIGS. 1, 8A, 8B, 10 and 11, a template mounting system 150 in accordance with an embodiment is described. The template mounting system 150 may permit reversal of a template 118 having two guides 116, 122 by implementing two-spaced apart assemblies. In this manner, a first guide may be utilized for forming a first type of joint (e.g., a ½" (one half inch) fixed spacing half-blind dovetail) while a second guide on a second side of the template is configured for forming a second type of joint (e.g. a sliding tapered dovetail) when the second guide is directed towards the front of the jig apparatus (as may be observed in FIG. 1) or first side 106 of the base. In the current embodiment, the mounting system 150 includes an outwardly extending threaded rod 138 secured via a nut, adhesive, a weld, or the like for preventing the rod 138 from becoming dislodged or lost from the base 102. Securing the rod 138 to the base 102 may prevent rotation of the rod as various components are threaded into engagement with the rod. The threaded rod 138 may be positioned in order for the jig apparatus to accept a wide variety of workpieces having varying thickness. In the current embodiment, a nut such as a knurled nut 142 having an internal threading corresponding to the threaded rod is engaged with the rod 138. Other suitable devices include, a wing nut with the wings directed inwardly towards the base, a knob having a Mange, and the like. In the current embodiment, the nut 142 may act as a stop for defining the front-to-back position of the template 118 with respect to the first side 106 as generally indicated by arrow 148. For example, if a thinner piece of lumber is to be positioned against the first side 106, the nut 142 may be spaced closer to the first side of the base while a larger workpiece may require the nut 142 be positioned further away. Moreover, adjustment of the template towards/away 148 from the first side 106 may be especially useful for positioning the template when a piece of scrap material, or a sacrificial piece of material, is disposed between the base and the workpiece for preventing tear-out on the back side of the workpiece, i.e., the side adjacent the base. In addition, when culling through dovetail pins, manipulating the template towards/away 148 from the first side 106 may influence the tightness of the joint. For instance, positioning the nut 142, and thus, the template 118, closer to the base may result in a looser joint than if the nut and template (the template bracket) are disposed further away from the base 102 for the same workpiece. An additional nut or knob 146 having a threaded aperture may be utilized to secure the template bracket 120 in a desired position.

Figure 10:
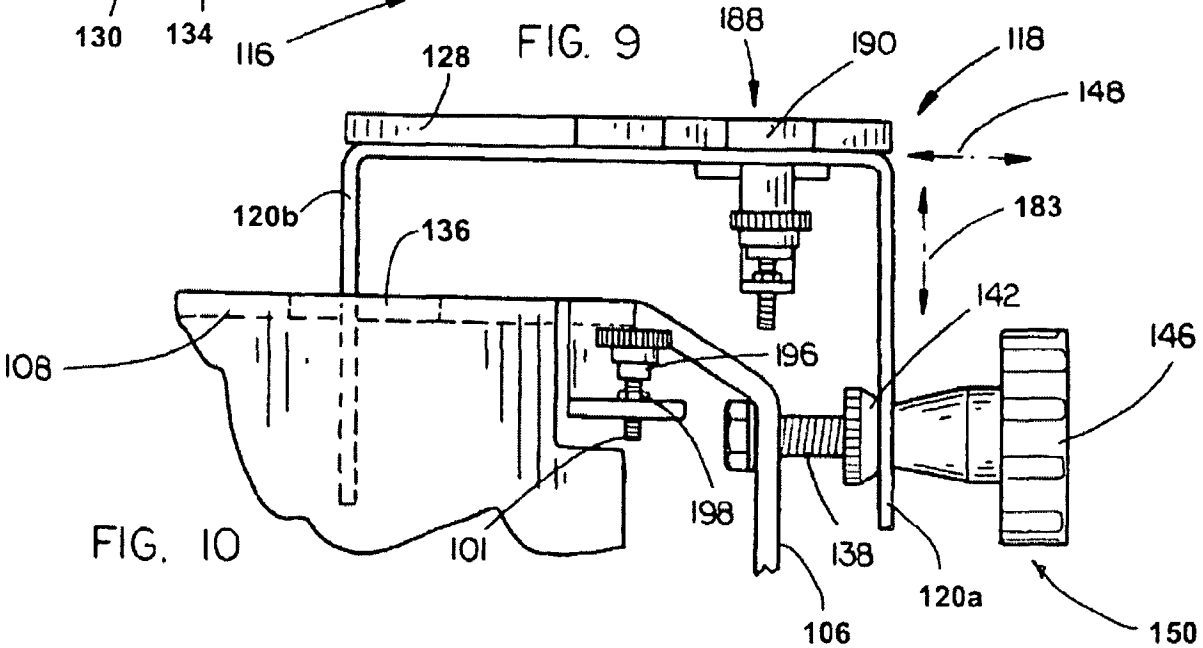
FIG. 10 is a partial cross-sectional view of jig apparatus in accordance with an aspect of the present invention.
Figure 11:
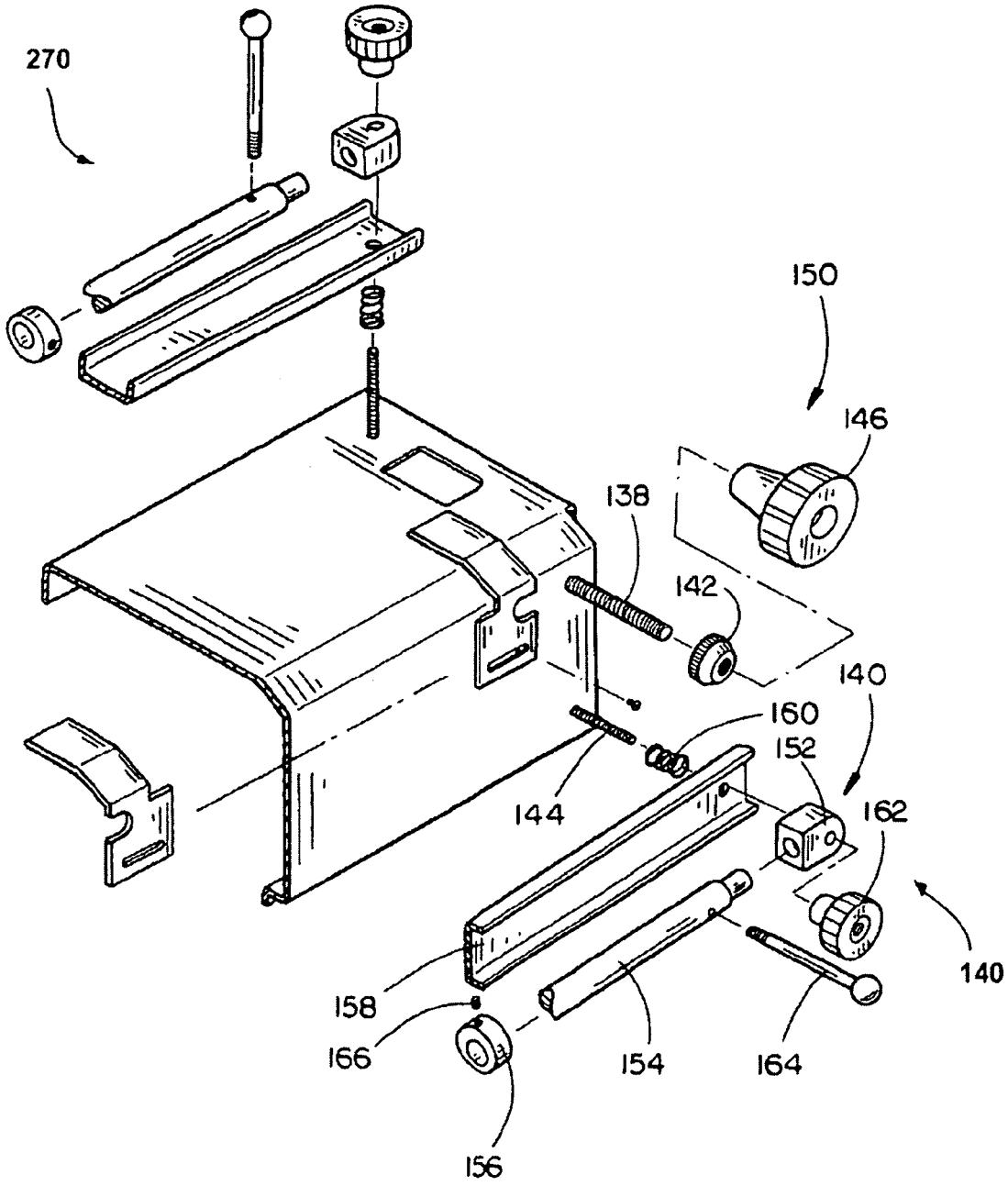
FIG. 11 is a partial exploded view of template mounting system and clamping mechanism in accordance with an aspect of the present invention.
Figure 12:
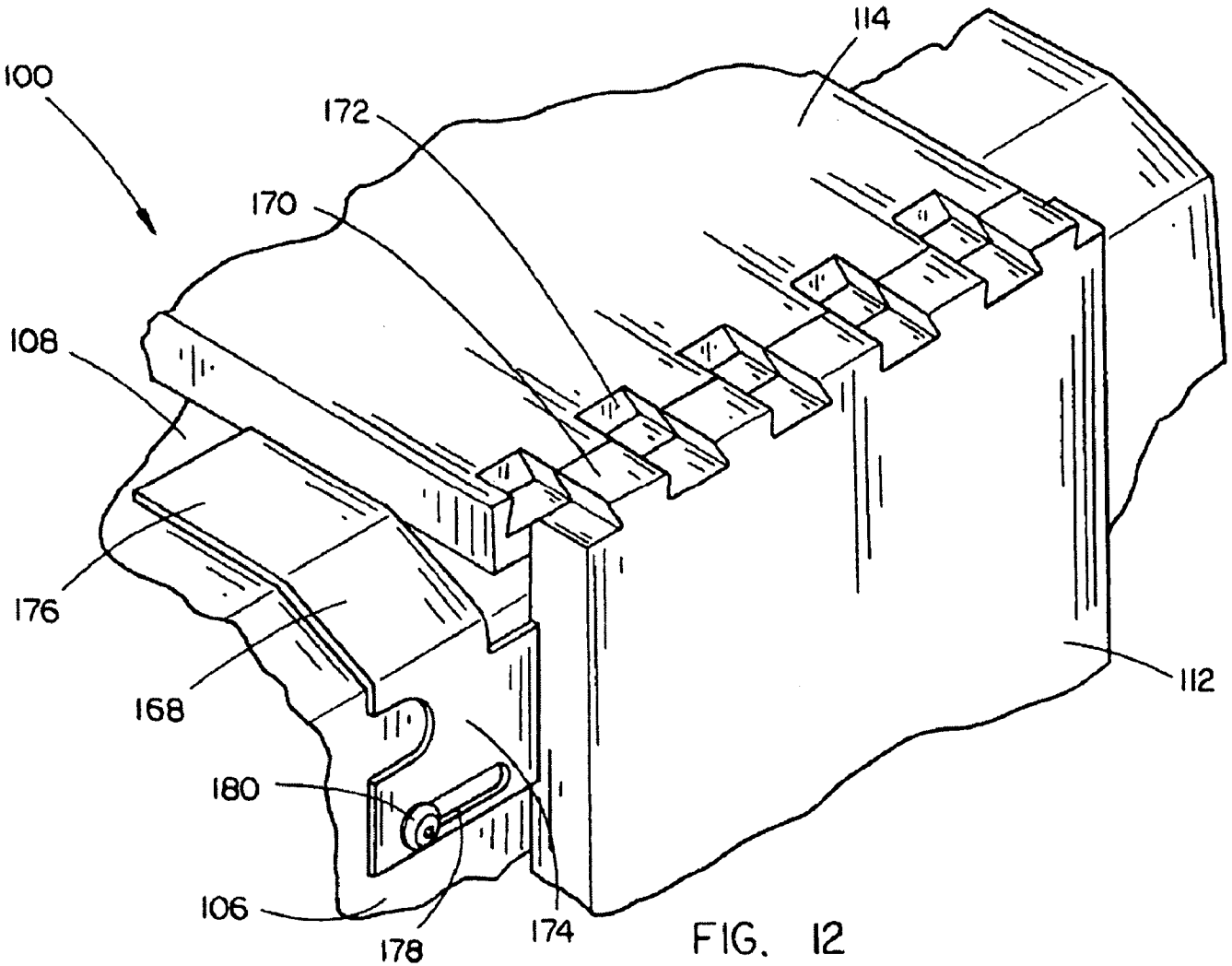
FIG. 12 is a partial view of a workpiece stop being generally implemented for single pass half-blind dovetail formation.

In the present embodiment, the position of the template 118 with respect to the second side 108 of the base (e.g., the vertical position as may be observed in FIG. 10) may be varied by positioning the bracket with respect to the threaded rod 138 (generally represented by arrow 183). The bracket slot 132 may be configured for permitting efficient adjustment for the range of workpiece thickness expected to be secured along the second side. With particular reference to FIGS. 8A and 10, a workpiece 114 may be positioned on the second side 108 of base 102, and the template bracket 120 may be slid down around the threaded rod 138 until the main body 128 of the template 118 contacts the workpiece 114 at which lime the securing knob 146 may be lightened against the bracket 120 to fix the template's position. Additionally, while an end slot 132 is preferable so the knob 146 does not have to be removed during assembly, a through aperture may be employed as well. In a further example, the template 118 may be spaced a desired distance away from the workpiece so as to allow workpiece removal without adjustment of the template. In the described manner, the jig apparatus 100 may be set-up for repeated operations requiring repeated positioning and removal of workpieces such as for all the drawers having the same thickness for a project.

Figure 9:
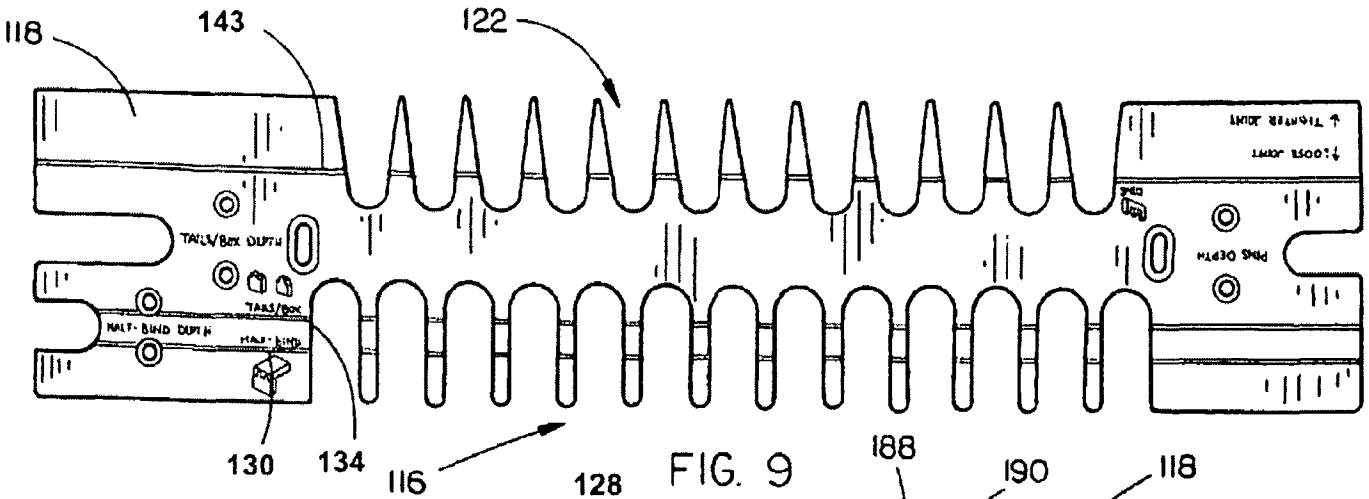
FIG. 9 is a top plan view of an exemplary template in accordance with an aspect of the present invention.
Figure 17:
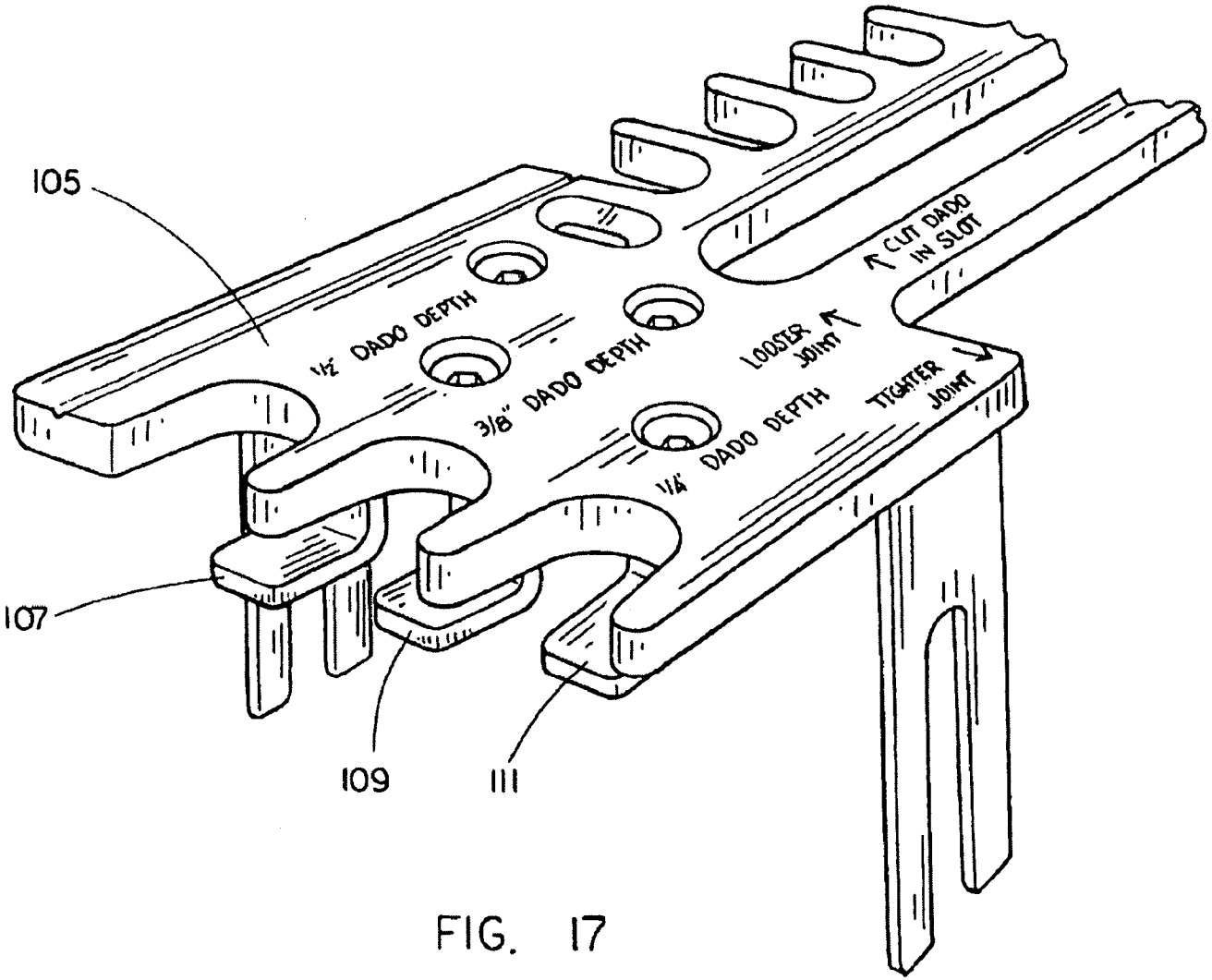
FIG. 17 is partial isometric view of a template including a fixed depth router bit positioning system.

With reference to FIGS. 8B, 9, and 17, in an aspect of the present invention, a visual alignment system for inclusion in a jig apparatus is disclosed. Previously, users may have experienced some difficulty in aligning the template in order to prevent the template from being skewed with respect to the workpiece(s), thereby resulting in pins/tails of differing lengths, or requiring time consuming measuring and set-up. In the present embodiment, an alignment marker or indicia is included on a template for aiding in alignment of the template with the workpiece. Suitable alignment markers include printed, embossed or painted indicia, an etched, or engraved marker, or the like for aiding visual alignment. Alignment markers include a line, an arrow, two-spaced apart lines, a cross-hair, alignment dots, dashed lines, and the like. Other suitable systems include, apertures having alignment markers or visual indicators, or transparent windows having visual markers. For example, with previous jigs, a user had to estimate or measure to determine that the template was properly aligned with the end of the workpiece to be formed. The alignment system of the present invention may allow the user to visually align an appropriate marker or indicia to the workpiece in order to ensure proper alignment. For example, when cutting or shaping a half-blind dovetail in a single pass, a user may align a scribed line 130, included on the main body of the template 118 with the interface between a first workpiece 112 disposed along the first side 106 of the base (e.g. in a vertical orientation) and a second workpiece 114 disposed along the second side 108 of the base (e.g., in a horizontal orientation). As may be generally observed in FIG. 8B, should the template not be in alignment with the half-blinding dovetail alignment line 130, a user may manipulate the template towards/away from the first side of the base until the alignment line coincides with the interface of the first and second workpieces. Those of skill in the art will appreciate that a variety of indicia or markers may be included for aligning guides for other types of joints. For example, as may be observed in FIG. 9, additional indicia may be included for the different types of joint guides such as an alignment marker 134 for the tails for a through dovetail and an alignment marker 143 for through dovetail pins. For example, when cutting the pins of a through dovetail, a user may align the edge of the workpiece in which the pins are to be formed with the alignment marker 143 included on the template guide 122 for through dovetail pins.

Referring to FIGS. 13, 14, 23, and 24, a template 193 and template mounting system 181 in accordance with an additional aspect of the present invention are disclosed. The template and template mounting system of the present invention may permit efficient template positioning and set-up for the jig apparatus. More particularly, the template mounting system 181 of the present aspect may allow for front-to-back positioning (i.e., positioning with respect to the first side of the base 106 (as generally illustrated by arrow 179, FIG. 14)). Additionally, the mounting system 181 may permit vertical adjustment of the template (i.e., adjustment with respect to the second side of the base 106 (as generally illustrated by arrow 183, FIG. 23)). In a preferred embodiment, a pair of spaced apart template mounting brackets 139 (one is referenced) is secured to generally opposing ends of the base.

In the current example, the mounting system 181 includes a template mounting rail 141 included on a template mounting bracket 139. The mounting rail may be unitary with a base mounting 187 or may be secured via fasteners to a base mounting 187. For example, the mounting rail may be aligned generally perpendicular to the first side 106 of the base for front-to-back alignment. The mounting rails may be shaped/disposed so as to minimize and/or eliminate skewing of the template along the mounting rails. The template mounting rail may be configured as a rod or geometrically shaped elongate extension. As may be observed in FIG. 24, in the present example, a template 193 for use with the mounting system includes a recess 195, a channel, or an aperture corresponding to the rail cross-section to permit engagement of the template along the rail. For instance, the template recess 195 extends generally perpendicular to the main axis or length of the template 193. In the foregoing example, a thumb screw 197 may be coupled to the template for fixing the position of the template 193 along the mounting rail during utilization.

Figure 23:
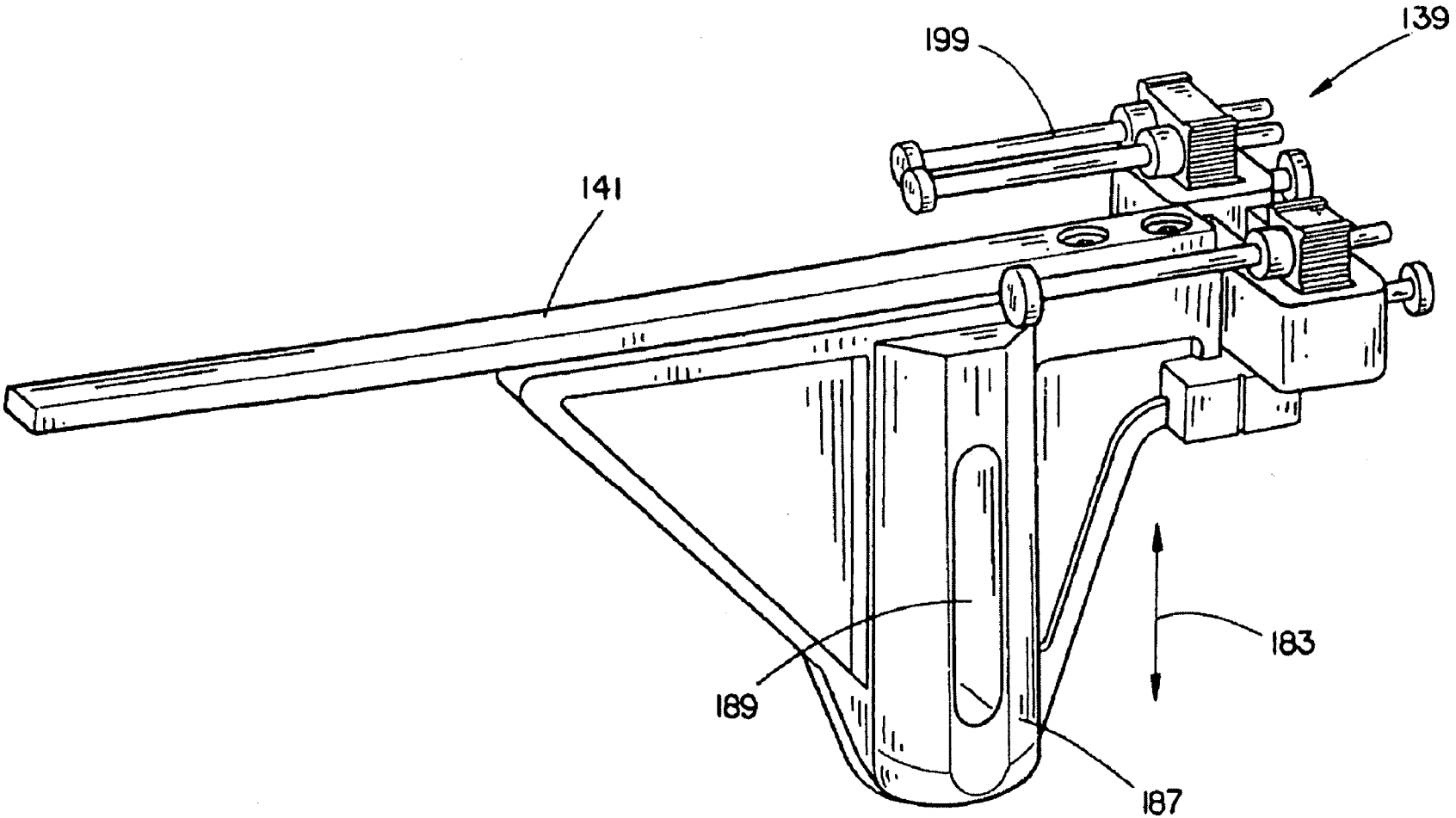
FIG. 23 is an isometric view of a template mounting bracket in accordance with an exemplary embodiment of the present invention.
Figure 24:
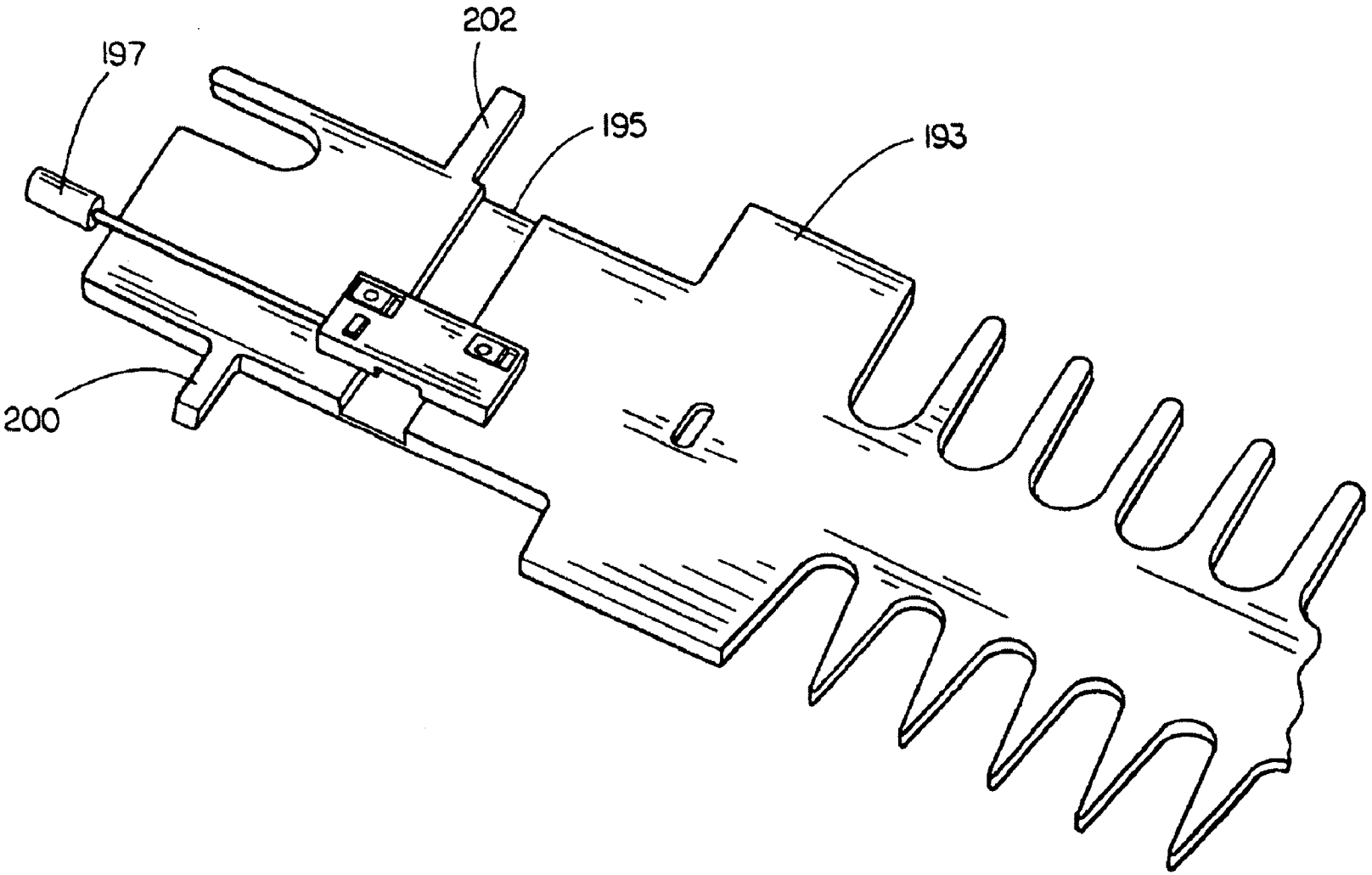
FIG. 24 is a partial view of a template suitable for engagement by a mounting rail included in a template mounting bracket in accordance with an exemplary embodiment.

With particular reference to FIGS. 13 and 23, the base mounting 187 may include a slot for receiving a threaded rod such as an outward extending bolt or the like for securing the template mounting bracket 139 in a desired position. Those of skill in the art will appreciate the template mounting bracket 139 may, alternatively, include a threaded extension which is received through a slot formed in the base for substantially the same purpose. In the current example, a knob 191 having a threaded aperture or recess may be secured to an outward extending threaded rod which extends through the base mounting slot 189 for permitting adjustment of the template mounting system 181/the template 193 as may be generally illustrated by arrow 183 (FIG. 23). The base mounting 187 may be variously shaped in order to minimize misalignment and the like. As may be observed in FIG. 23, the base mounting 187 may include a hexagonal or the like sided cross-section (with a corresponding recess or aperture formed in the base) for preventing movement of the template/mounting system 181 during utilization.

In a further example, the template mounting system 181 may include a mounting stop 199 (one is referenced) or a series of mounting stops (which may be fixed or adjustable) for aiding in positioning of the template along the mounting rail. Those of skill in the art will appreciate an adjustable stop may be mounted to a template for a substantially similar purpose. For instance, an adjustable stop 199 may be included for contacting the template 193, a stop 200 extending from the template 193, or an adjustable stop mounted to the template so as to permit positioning along the mounting rail 141. In this way, a user may set the alignment of a particular guide included on a template and repeatably position the template having the guide to the desired position for a variety of different guides. Adjustable positioning of the template along the mounting rail 141 may accommodate various sized workpieces, permit adjustment of the lightness/looseness of the joint, permit utilization of a sacrificial backer for preventing tear-out, and the like. Preferably, corresponding stops are included on the template mounting brackets 139 disposed at either end of the base. Additionally, a stop may be removable and/or replaceable to allow for the implementation of different router bits. In a further advantageous embodiment, a series of stops, being offset from at different locations from the mounting rail, are included to allow for front-to-back positioning (position along the mounting rail 141) for different guides. In a further example, a stop may be included on the mounting bracket 139 for contacting a corresponding stop 200 on a first side of the template while a second stop is included on the mounting bracket for contacting a second stop 202 disposed on an opposite side of the template. The stops included on the template 193 being disposed at differing locations along a primary length of the template 193. In the foregoing manner, a series of different templates, each having different guides, may have established stops for the included guides. Examples include a stop for through dovetail pins, a stop for through dovetail tails and or half-blind pins/tails, and the like guides. The adjustable stop may be constructed as a threaded rod, a screw, or the like in threaded engagement with a threaded aperture included in the mounting bracket 139. Other securing systems such as a rack and pinion system, a smooth shall and set-screw, or the like may be implemented as well.

Figure 25:
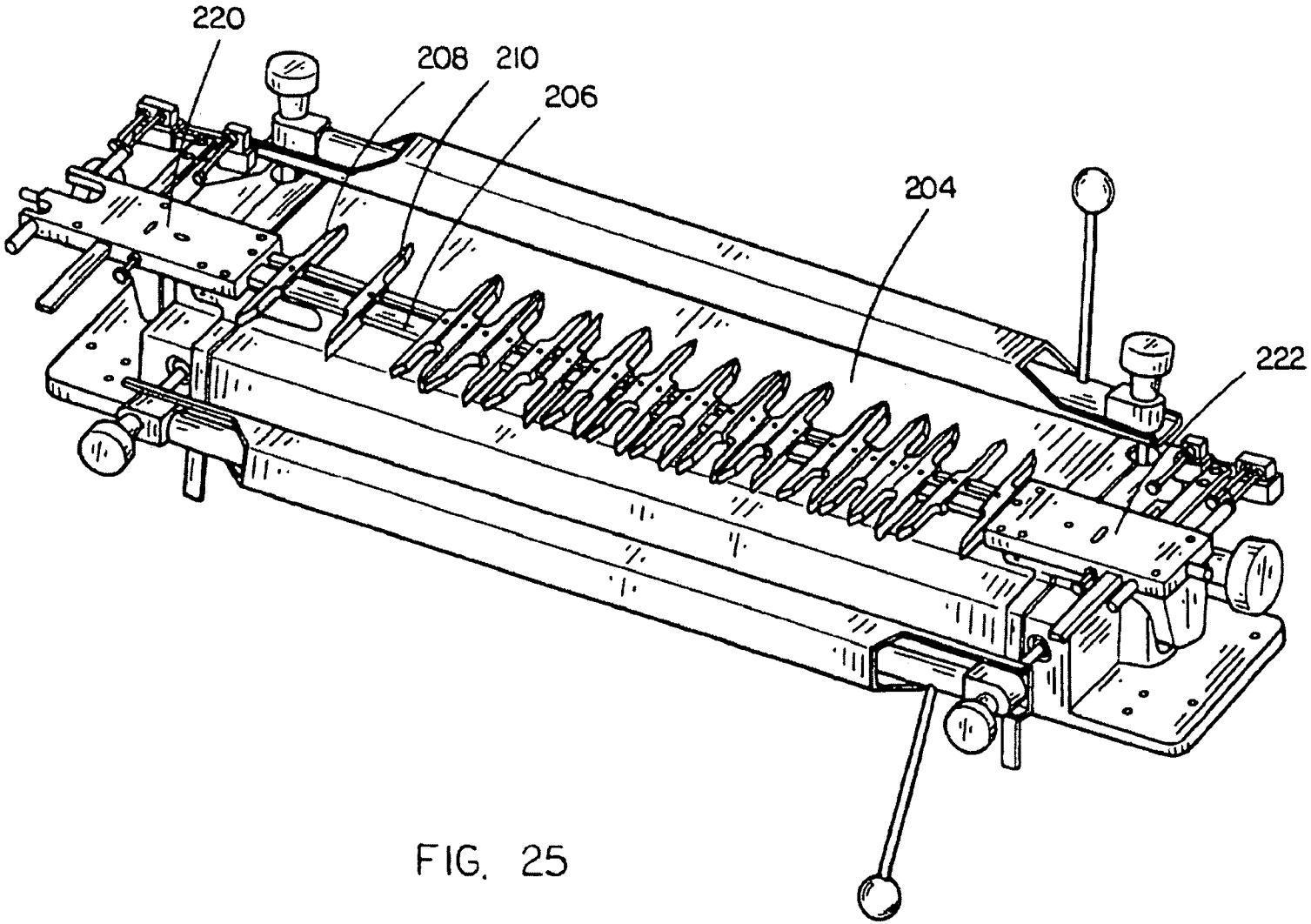
FIG. 25 is an isometric view of a jig apparatus including an adjustable finger template in accordance with an exemplary embodiment.
Figure 26:
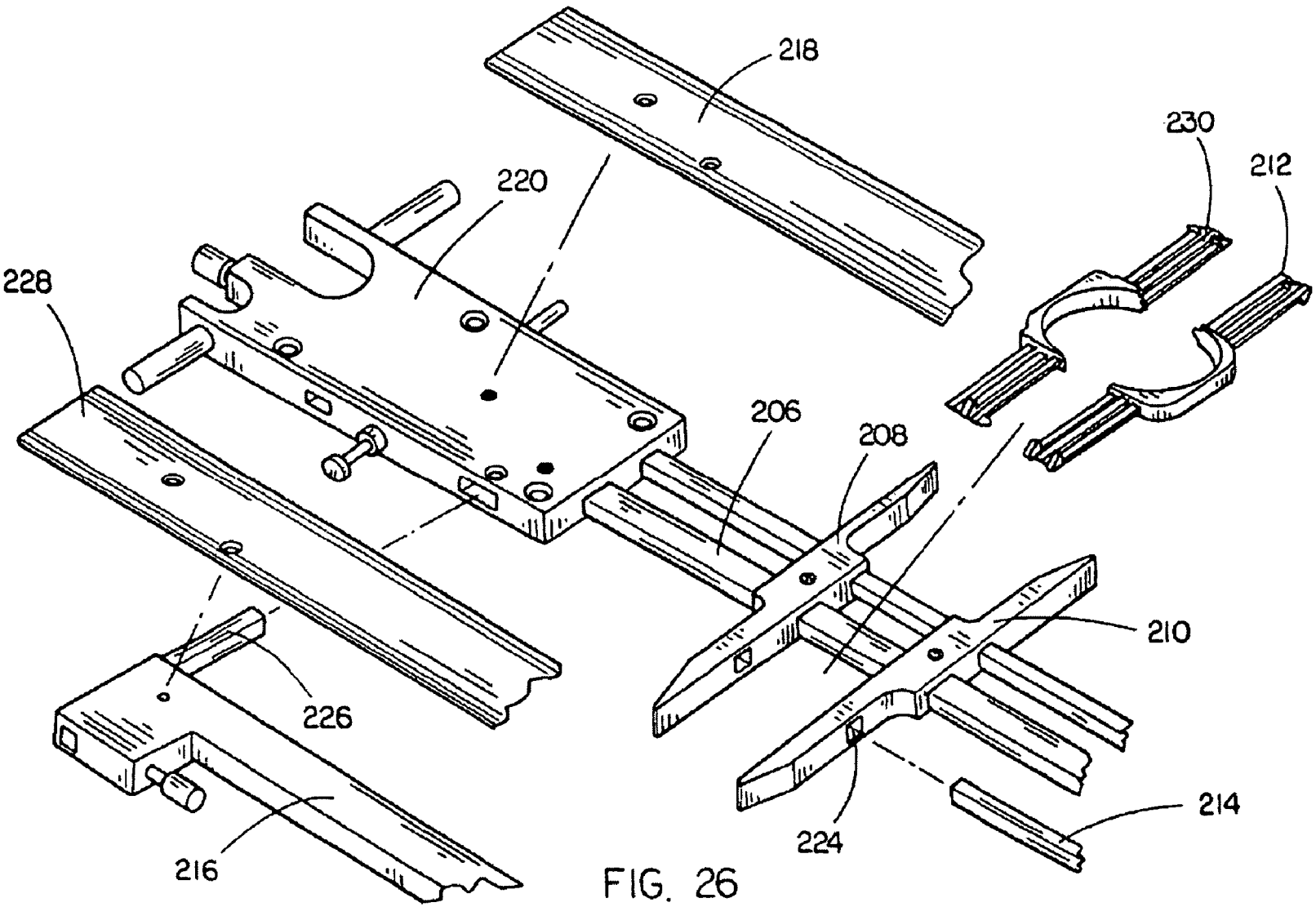
FIG. 26 is an exploded view of an adjustable finger template implemented for forming mortise and tenon joints in accordance with an exemplary embodiment.
Figure 27:
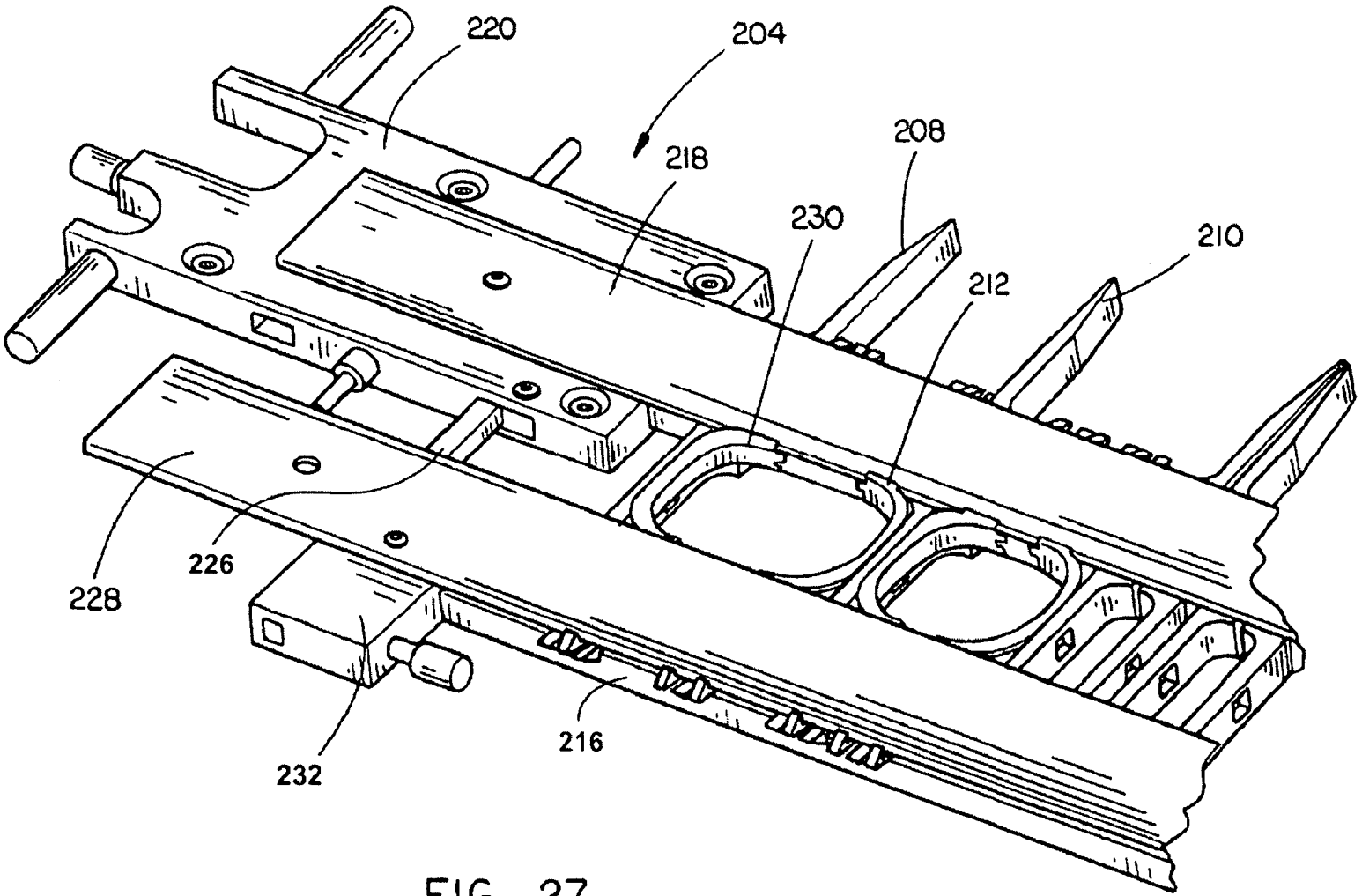
FIG. 27 is an enlarged view of an adjustable finger template implemented for forming mortise and tenon joints in accordance with an exemplary embodiment.

With reference to FIGS. 25 through 27, an adjustable finger template 204 for utilization in forming various joints such as through dovetails and hall-blind dovetails, is described. The template of the present invention may provide a guide for forming joints of differing dimensions such that the pins/tails forming the joints may be sized as desired. Those of skill in the an will appreciate the principles of the present embodiment may be implemented for templates for different joints, such as for a mortise and tenon joint and the like, without departing from the scope and spirit of the present invention.

An adjustable finger template 204 in accordance with an embodiment includes a first end mounting 220 having a through aperture for reception by a mounting rail 141. A second end mounting 222 may be connected to the first end mounting via a template rail 206 extending between the end mountings. Additional rails may be included for preventing twisting of the template during utilization. A plurality of individual fingers may be slid on the template rail 206 to the desired position. The individual fingers 208, 210 (two are referenced) may be contoured in a variety of shapes based on the joint to be formed. Individual fingers may be secured via a set-screw or the like to fix their respective positions along the template rail 206.

In the present example, a through aperture 224 is included in the individual fingers for permitting passage of a depth stop rod or bar 214 through the fingers. For instance, the depth stop bar 214 may act as a stop for a router guide collar when forming a joint, so the router is prevented from extending inwardly between two adjacent fingers. In the foregoing manner, a user may be prevented from inadvertently removing excess material from the workpieces when forming half-blind dovetails. The depth stop bar 214 may be removed when cutting through dovetails, as the bit is allowed to pass entirely through the workpiece.

Figure 20:
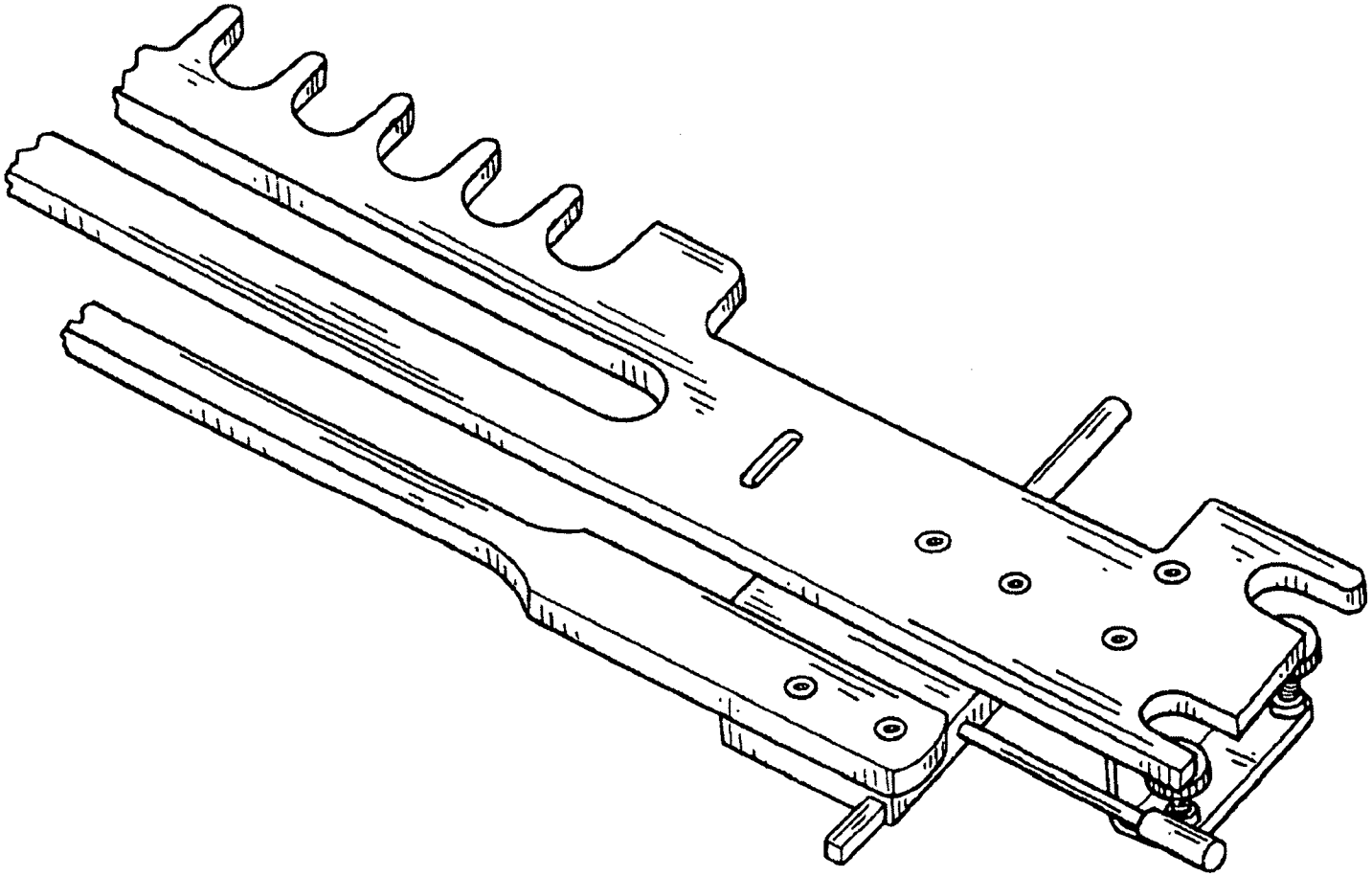
FIG. 20 is a partial isometric view of a template including variable position guide for forming a tapered sliding dovetail tenon.

When utilized for forming a mortise and tenon joint, a removable support 216 may be attached to the adjustable finger template 204. The removable support 216 may be attached via a rail system in a substantially similar manner as the template mounting system 181. Referring to FIG. 20, in a further example, a guide for forming a sliding tapered dovetail tenon may be coupled via a rail to permit implementation of a different material for a portion of the template. Referring to FIGS. 25 through 27 again, a rail or rod 226 connection between the adjustable finger template 204 and an end mounting 232 of the removable support 216 may permit adjustable positioning of the support 216 adjacent the fingers 208, 210 so that mortise and tenons of different dimensions may be formed. For example the removable support 216 may be spaced away from the template rail 206 sufficiently to allow for the formation of a ½" (one-half inch) mortise and tenon. For example, the removable support is disposed away from the template rail equal to the diameter of the mortising template guide (discussed below). The removable support may be additionally space further away if a larger joint component is desired. Additionally, template supports 218 and 228 may be included for providing a substantially planer surface for a router to at least partially rest upon. A template support 228 positioned adjacent the removable support 216 may be disposed on a side of the fingers 208 and 210 opposite the removable support in order to sandwich the fingers and to engage removable inserts 212 and 230 for forming curved corners of the mortise and tenon. The inserts 212 and 230 may be sized for commonly formed mortise and tenons. In embodiments, the inserts may be assembled from multiple sections to permit fine mortise and tenon size adjustment. Examples include ½" (one-half inch) inserts, ⅜" (three-eighths inch) inserts, and ¼" (one-quarter inch) inserts. The inserts 212, 230 may be snap fit to an adjustable finger 208, 210, sandwiched between the removable support 216 and a template support 228, and the like. In further embodiments, a dedicated mortise and tenon jig may be configured in a substantially similar manner.

Referring to FIGS. 1, 8A, 8B, and 11, a securing mechanism in accordance with an embodiment of the invention is discussed. In the present embodiment, a clamp assembly 140 is utilized to secure a workpiece in a fixed position with respect to the base/template. It is to be appreciated that while the clamp assembly 140, disposed adjacent the first side 106, is discussed, an additional securing mechanism 270 may be positioned adjacent the second side 108. The clamp assembly 140 permits efficient coarse and fine adjustment in order to permit rapid workpiece securing.

In the current example, a threaded rod 144, a bolt, or the like extends outward from a portion or side of the base 102 to which the workpiece is to be clamped. The threaded rod or bolt may be secured to the base via a weld, an adhesive, a nut 185, via threaded engagement with a threaded aperture in the base, or the like, to prevent rotation of the rod as the clamp assembly components are manipulated. In further embodiments, the knob may include a threaded rod which engages with a threaded aperture in the base. In this manner the clamp assembly may be removed such as when attaching a adjustable angle fence or when a user wishes to have a flush, surface. During utilization, a workpiece 112 such as a wooden board may be sandwiched between a surface 106 of the base and the clamp assembly 140. In the present embodiment, a threaded rod extends from each of the left and right edges of side 106 of base 102 in order to promote even clamping pressure along the width of the workpiece 112. A mounting block 152 is mounted on the threaded rod 144. In the current embodiment, the mounting block 152 includes a through aperture so that the mounting block may slide along the threaded rod 144. A lock bar 154 is pivotally coupled to the mounting. For example, the lock bar 154 may have a terminal portion which forms a trunnion for which a corresponding aperture or recess is included in the mounting.

In the current embodiment, the lock bar 154 includes an eccentric portion 156 which is secured to the generally cylindrical lock bar 154 via a set screw 166 or the like for fixing the eccentric portions so that manipulation of the lock bar results in securing/releasing of the eccentric portions. Preferably, the eccentric portions are spaced apart to ensure that a proper securing force is applied generally along the length of the lock bar. In a further embodiment, multiple eccentric portions are implemented or cam portions are included. Moreover, the lock bar may have a variety of multi-sided geometric shapes, with a correspondingly shaped aperture in the eccentric or cam portion, so that rotation of the lock bar results in rotation of the eccentric portion. In further embodiments, the lock bar may be shaped/configured as an eccentric or cam or have integrally included eccentric or cam portions. Including separate cam portions may promote efficient manufacture, reduce material cost, and the like. The eccentric portion 156 may be formed of a durable plastic or the like having sufficient rigidity to withstand workpiece clamping pressure.

A workpiece engaging plate 158 may be included for providing substantially even pressure across a workpiece/engaging plate zone. Inclusion of a plate 158 may prevent the eccentric portions 156 from marring or otherwise damaging the workpiece 112 if excessive pressure is applied by the lock bar 154, as well as providing increased surface area. An engaging plate 158 may include surface texturing, a coating, or material, directed toward the surface of the base, for aiding workpiece engagement. In further embodiments, an engaging plate may include edges to form a trough or form a partial enclosure generally about the lock bar 154. Additionally, the lock bar and or the mounting block 152 may be biased away from the base to permit efficient insertion of a workpiece between the base 102 and the securing mechanism, for example, a compression spring 160 may be disposed about the threaded rod 144 between the base 102 and the engaging plate 158 in order to force the engaging plate and lock bar generally away from the base to facilitate workpiece insertion when the clamp assembly 140 is not in an engaged condition.

With continued reference to FIGS. 1, 8A, 8B, and 11, in the current embodiment, an adjustable knob 162 (which may be substantially similar to knob 146) is in threaded engagement with the threaded rod 144. It is to be appreciated that the knob may include a separate nut having a threaded aperture corresponding to the threaded rod 144 or be integrally formed with a threaded aperture. The knob 146 may include protrusions and/or surface texturing for promoting ergonomic grasping/manipulation. When securing a workpiece, a user may position the workpiece 114 to the desired location between the base 102 and engaging plate 158, the knobs 162 generally on either end of the lock bar are threaded towards the base until the mounting 152/lockbar 154 are positioned or slid sufficiently close to the workpiece 112 in order for the eccentric portions 156 to sufficiently engage the workpiece to prevent movement of the workpiece during shaping or routing operations. Those of skill in the art will appreciate that the steps/order of the foregoing method are exemplary only and are not to be understood as limiting. Once the knobs are threaded to the desired positions the lock bar 154 may be rotated utilizing a lever or handle 164 fixed to the lock bar, thereby clamping the workpiece. In the foregoing manner, the clamping assembly may function to permit coarse adjustment via the threaded knob and line adjustment via implementation of the eccentric/lock bar.

Referring to FIGS. 1, 7, 8A, and 12, in a further aspect of the invention, a workpiece slop 168 is disclosed. In the present embodiment, the workpiece stop is unitary. In further embodiments, an adjustable workpiece stop may be included in the jig apparatus. The workpiece stop of the present aspect permits efficient positioning for various types of joints. The workpiece stop of the present aspect may allow for common adjustment for workpieces disposed on either the first or second side.

In particular, when cutting half-blind dovetails in a single pass, or operation, the two workpieces forming the joint are required to be offset from each other so as to align the edges of the workpieces to each other. For example, as may be best observed in FIG. 12, the position of the workpieces along the template must be offset so that each extension or pin 170 is received in a corresponding socket or recess 172 formed in the opposing workpiece. Typically, it is desirable for a half pin to be formed on either side of one of the workpieces so the joint appears uniform. As a ½" (one-half inch) fixed half-blind dovetail joint is the most common joint formed, it is desirable that the workpiece stop 168 have an edge which is offset by ½" (one-half inch) to accommodate this spacing. Those of skill in the art will appreciate the workpiece stop may be configured for other spacings (e.g. with the offset being the width of the pin/tail). Thus, a workpiece stop may include a first end 174 having an edge (along a side) which is offset from a second end 176 having an edge (along the side) such that workpieces disposed against the slop are offset the selected distance. Additionally, the generally opposing side of the workpiece stop 168 may be straight or in-line between the first and second ends so a uniform position may be established for positioning a workpiece along either the first side 106 or second side 108 of the base.

In a preferred embodiment, at least two workpiece stops are included in the jig apparatus 100 such that the workpiece stops may be swapped from left/right (as may be generally observed in FIG. 7). As the offset side of the workpiece slop, in the current embodiment, forms a handedness, reversal of the left handed stop for the right handed stop will result in the straight or aligned side being directed towards the area in which a workpiece is received in the jig.

In the current embodiment, a workpiece stop includes a slot 178 extending generally from the aligned side to the off-set side of the slop such that the right/left positioning of the workpiece may be finely adjusted thereby permitting adjustable and repeatable workpiece positioning along the length of the template. A fastener such as a screw 180, in threaded engagement with the base, or other releasable securing device may be utilized for securing the workpiece stop 168. For example, a user may wish to vary the position of the workpiece along the template. In this fashion, a user may select where the edge of the workpiece is located with respect to an extension or finger included on the template. In additional embodiments, portions of the workpiece stop 168 may include a contoured edge such as a half-circle recess to accommodate a threaded rod such as may be included in a template securing system, a clamping assembly, or the like to maximize the area in which a workpiece may be positioned or the size of workpiece which may be accepted.

Referring to FIG. 13, in an alternative embodiment, a multi-component workpiece stop 182 is included in a jig apparatus 100. While the jig of the present invention is implemented with a base having an intermediate stepped or recessed zone, the components of the workpiece stop may be configured to conform to an angled intermediate portion as well. In the present instance, the workpiece stop 182 includes a first workpiece stop portion 186 for alignment generally on a first side 106 and a second workpiece slop portion 184 for alignment on the second side 108. In the current embodiment, the first and second portions may be secured via a fastener while a slot formed in at least one of the portions is utilized to permit sliding adjustment with respect to the base, such as if a fastener extending through the slot engages with a threaded aperture in the base 102. The workpiece stop may include corresponding apertures, which may include threading for engaging the fastener, merely permit passage of a fastener, a slot such that one of the components may be repositioned with respect to the fastener/aperture included in an opposing workpiece component. In further embodiments, the workpiece stop 182 may be configured such that one portion such as the second portion 184 is disposed in a fixed position while the first portion is slideably adjustable, for example, the workpiece stop 182 may permit adjustment of the relative position of one of the workpieces with respect to another workpiece to be disposed along the other side of the jig. For example, a user may vary the distance that the workpieces are offset from each other while having the ability to reposition the entire workpiece stop without having to adjust the relationship of the portions of the stop (i.e., realign the first portion with respect to the second portion).

Figure 14:
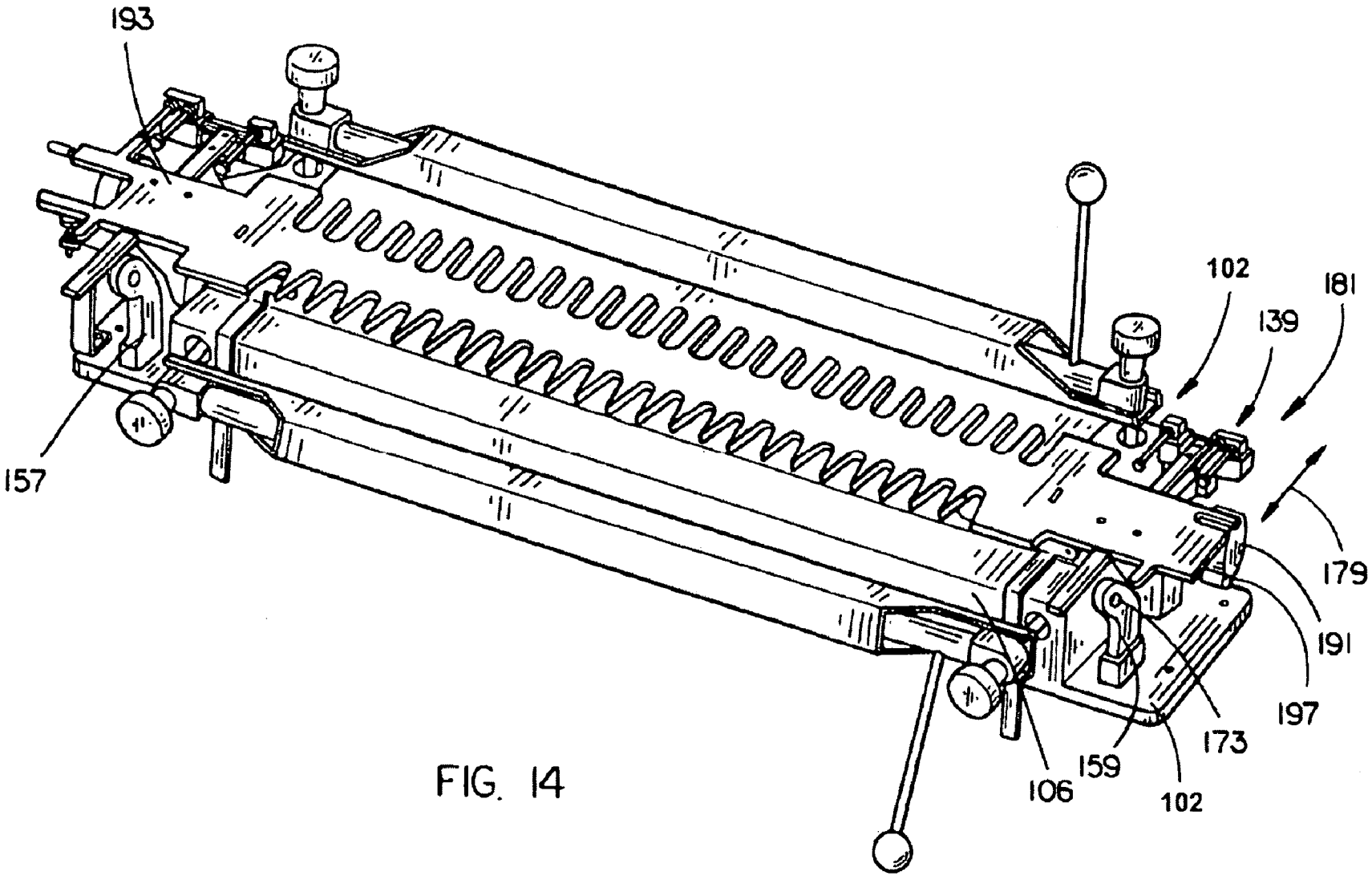
FIG. 14 is an isometric view of a jig apparatus including a removable template in accordance with an aspect of the invention.
Figure 21:
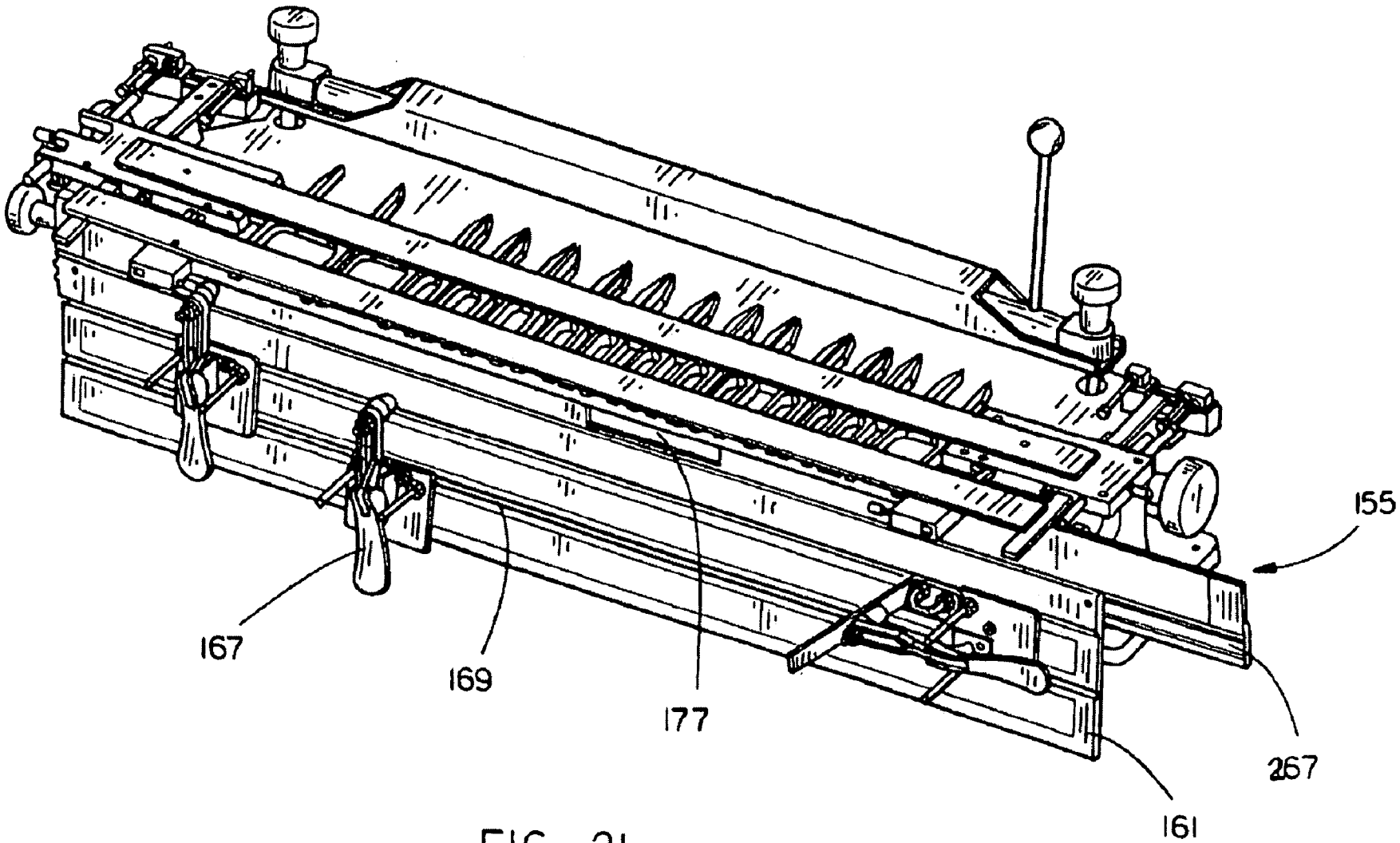
FIG. 21 is an isometric view of a jig apparatus including a variable angle workpiece mounting fence in accordance with an exemplary embodiment.
Figure 22:
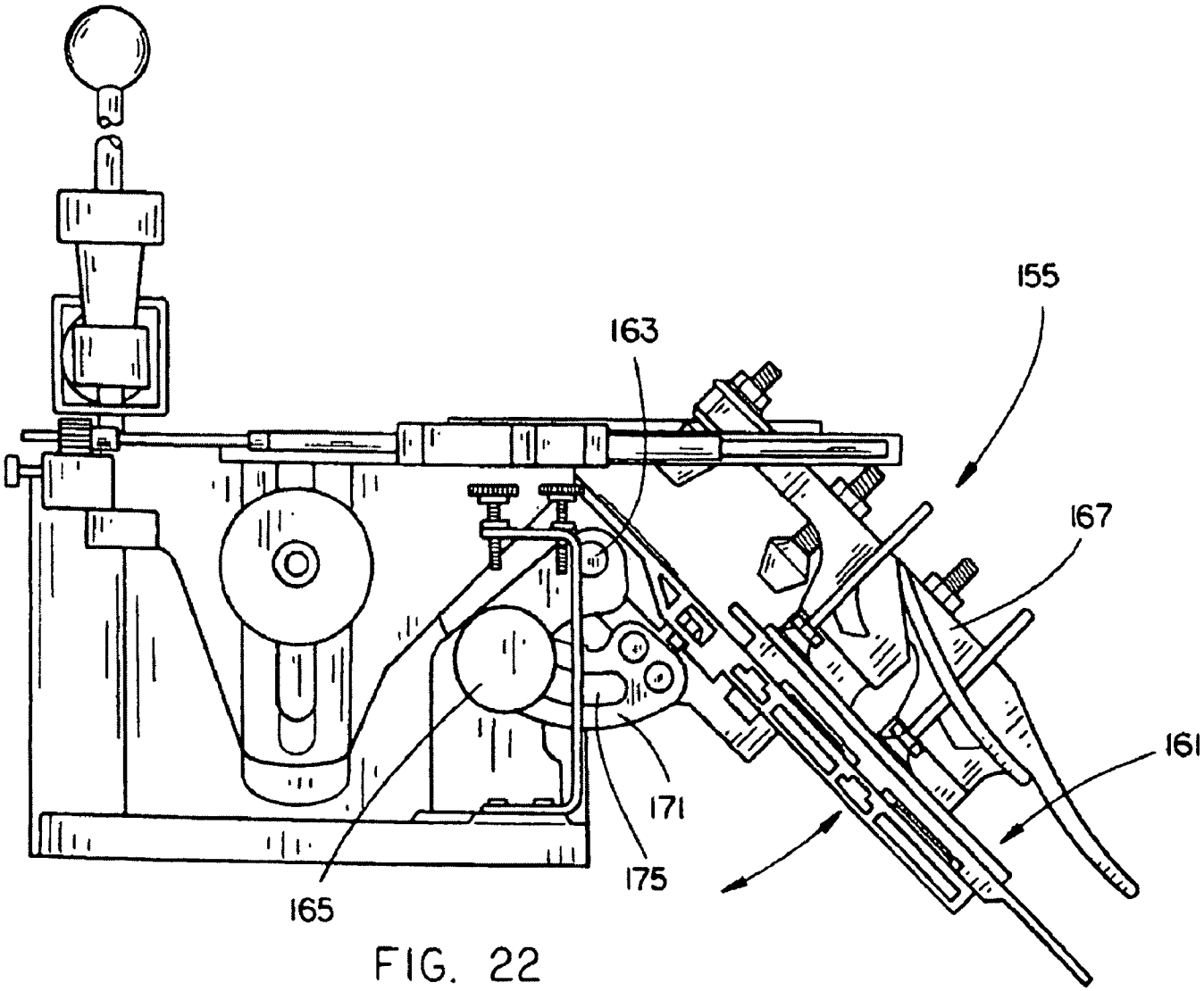
FIG. 22 is a cross sectional view of the jig apparatus of FIG. 21.

With reference to FIGS. 14, 21, and 22, an adjustable angle workpiece mounting fence system 155 in accordance with an aspect of the invention is disclosed. The fence system 155 may permit a user to vary the angular orientation of the workpieces forming the joint as desired. For example, a user may be capable of forming a dovetail joint for an angle other than 90.degree. (ninety degrees) such as to form a decorative box or the like. While the angle mounting system of the present invention is implemented as a removable attachment, those of skill in the art will recognize the system 155 may be integrated into a jig apparatus 100 without sacrificing the advantages described herein.

As may be best observed in FIG. 14, a pair of spaced apart fence mounting brackets 157, 159, respectively, are secured to the base 102 via fasteners or the like. In an embodiment, the brackets 157, 159 are secured on either side of a base flange 104, adjacent the first side 106. Referring to FIGS. 21-22, the main fence portion 161 may be pivotally coupled to the mounting bracken via a trunnion 163 received in a recess or aperture 173 included in the fence mounting brackets. Angular positioning of the workpiece fence system 155 may be accomplished by including at least one of an extension 171 or a portion of the main fence 161 having an arced slot 175. The angular position of the main fence 161 may be secured via a locking system such as a threaded knob 165, a bolt, a wing nut, a screw, or the like for engaging the material defining the arced slot. Preferably, an adjustable or sliding fence portion 267 (FIG. 22) may be coupled to the main fence 161 via a mechanical interconnection such as a grove 169, rail or the like. Inclusion of a sliding fence portion 267 may permit removal of the sliding fence portion when support is unnecessary of when inclusion of the sliding fence portion would interfere with the operation to be performed. For example, a user may select to remove the sliding fence portion 267 when cutting a tenon to be included in a mortise and tenon joint in order to provide clearance about the area in which the router bit is to be manipulated. In further examples, a recess or aperture 177 may be included in the sliding fence portion such that a user may align the recess as necessary to permit proper bit clearance while supporting a workpiece along the fence system 155.

Additionally, a securing system such as a securing clamp 167 may be included in the mounting fence system 155. In the present embodiment, a series of lockdown clamps are slide mounted to the main fence portion 161. In an example, a lockdown clamp is removable from the main fence portion 161 to accommodate workpieces having dimensions approximately equal to the maximum sized workpiece which may be accepted. Adjustable securing may allow for efficient securing for workpieces having various dimensions without the need for a separate clamping device. For example, the clamps may be coupled via a tabbed extension, a rail portion, or the like for engaging with a lipped groove to permit adjustment along the primary length of the main fence portion 161. Those of skill in the ail will appreciate a wide variety of mechanical interconnections may be implemented to permit adjustable workpiece securing. Suitable securing systems may include spring biased clamps, threaded clamps, cam or eccentric clamping system, and the like for securing a workpiece during routing operation.

Figure 15:
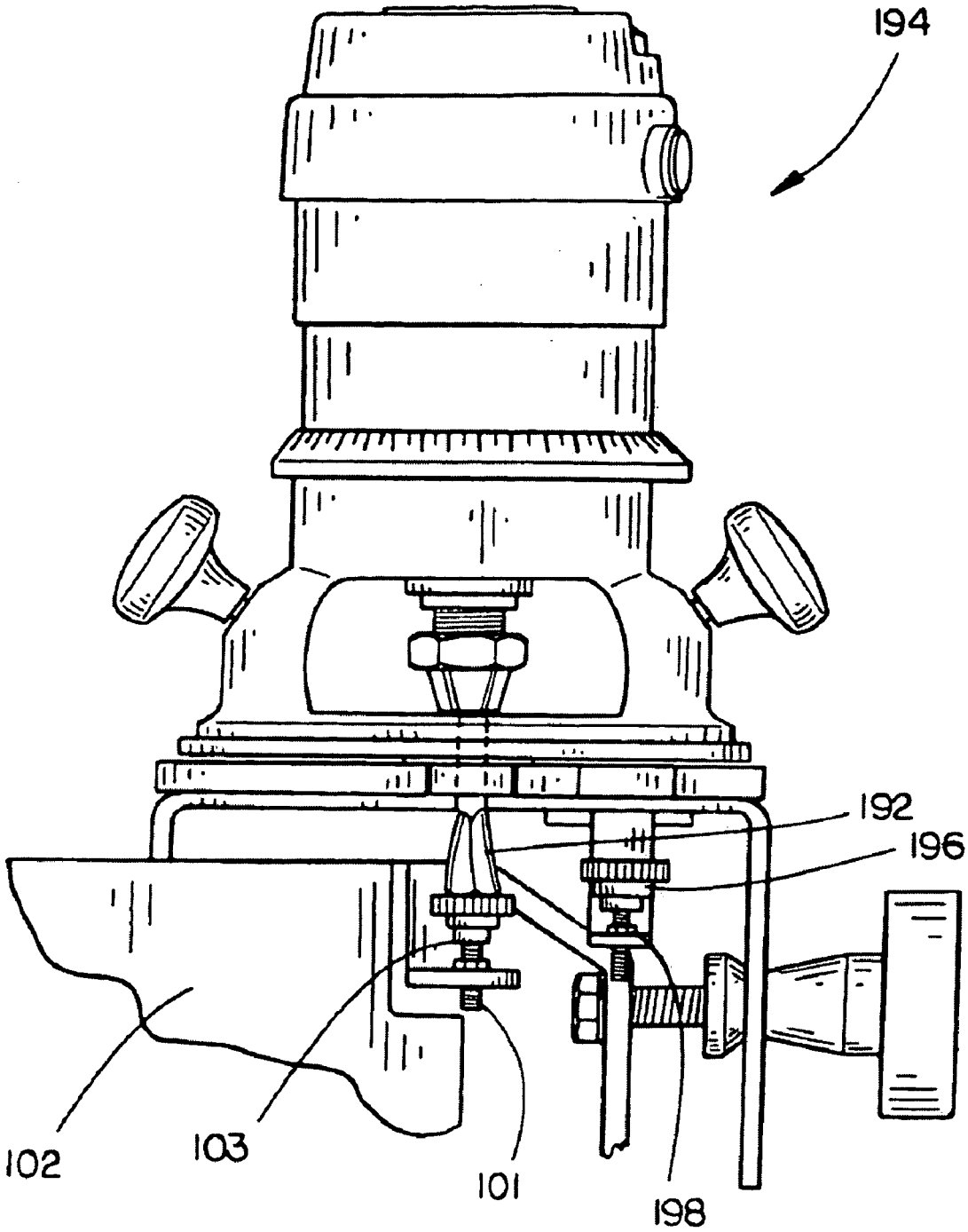
FIG. 15 is a partial cross-sectional view of a router being implemented with a router bit positioning system in accordance with an aspect of the present invention.
Figure 16:
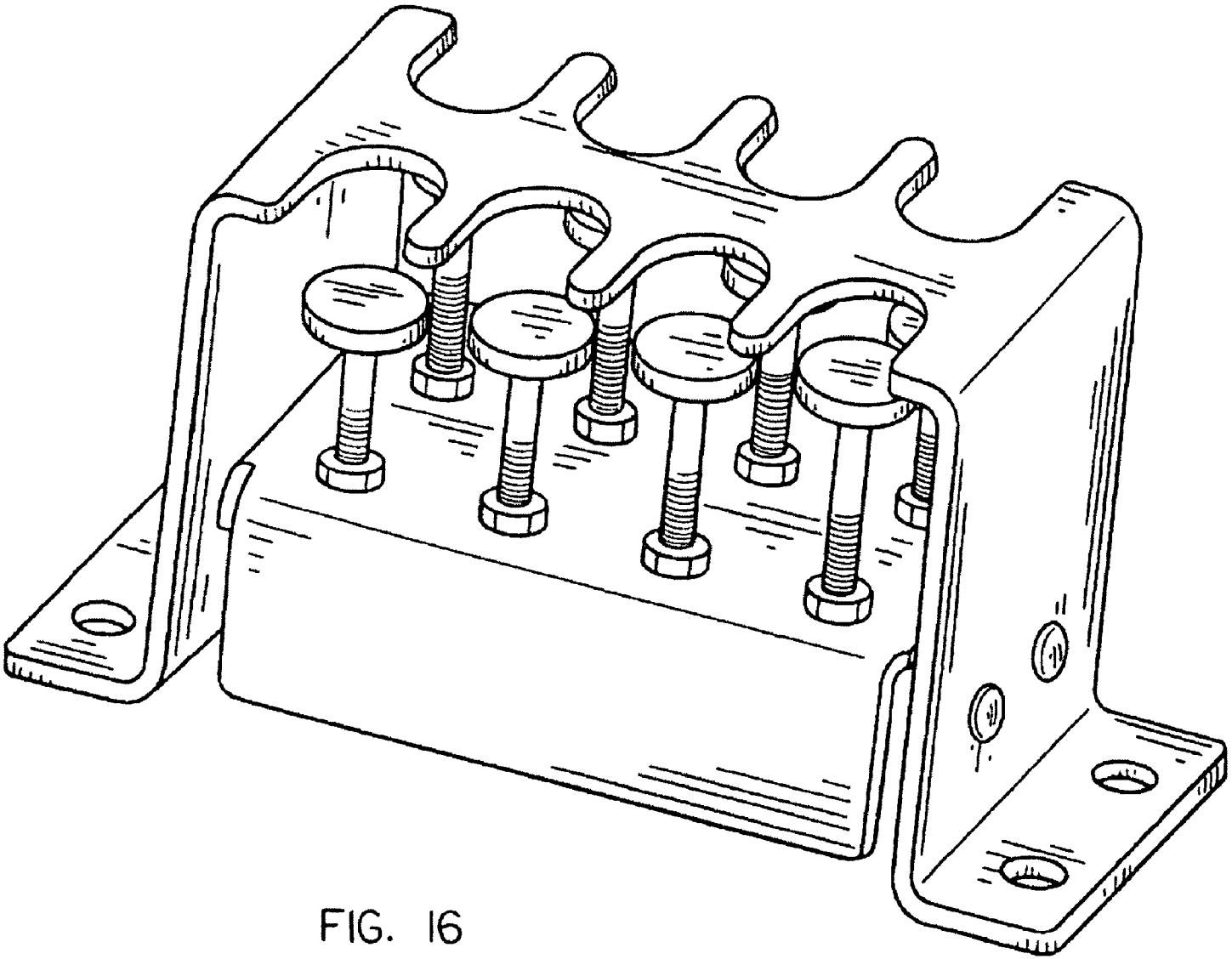
FIG. 16 is a general illustration of a router bit positioning system integrated in a separate housing.

Referring to FIGS. 1, 7, 9, 10, and 15, a router bit positioning system 188 in accordance with an aspect of the present invention is discussed. One drawback to forming joints utilizing a router is the need to properly position the depth of the router bit or the extent to which the router bit extends beyond the base and/or a sub-base plate of the router. This may become a time consuming task as a user fine tunes the depth of the router bit. The router bit positioning system 188 of the present invention may eliminate the need to perform test cuts, or eliminate having to measure the depth of a router bit utilizing a ruler or measuring tape. For example, some woodworkers select to leave the tails included in the joint long so they may sand them off, this may require precise measuring which may tend to be tedious. The router bit positioning system 188 may permit the user to set a router bit positioning stop or utilize a pre-selected bit depth stop to allow for repeated positioning of the depth of the router bit. In a first embodiment, a slot 190 or recess is included in the template 118. Preferably, the slot may be sufficient size to accept a router implementing a collar guide generally disposed about the shank of the bit. In additional embodiments, a through aperture may be utilized as well, with the aperture being of sufficient size to allow passage of the desired bit and/or collar. Referring to FIG. 15, for example, a slot extending in from an edge of the main body of the template 118 may permit the user to rest the router 194 on the template 118 and adjust the depth of the router bit 192 to the bit stop 103 (the through dovetail bit stop). In further embodiments, a separate housing may be included for one or more router bit positioning systems. In this example, the housing may function substantially as the template for resting a router thereon (as may be generally observed in FIG. 16).

Referring to FIGS. 1, 7, 9, 10, and 15, bit stop 196 (a half-blind bit stop in the present example) may be adjustable to allow a user to adjust the pre-selected depth as desired. For example, in an initial set-up procedure a user may adjust the position of the stop 196 so that he/she may reposition the bit to that relative position for the template guide selected without having to conduct test cuts or attempting to measure the extend to which the bit extends for the desired joint. Those of skill in the art will appreciate that multiple router bit positioning stops may be included such as a stop system for the pins of a through dovetail, a stop system for the tails of a through dovetail, a stop system for a half blind dovetail, and the like as desired. In the present embodiment, the adjustable bit stop includes a threaded portion such as a rod 101 for threading engagement with a threaded aperture included in the base, formed in a separate mounting or included on the template itself (such as mounted on a tabbed portion of the main body of the template or included on a mounting bracket attached to the template) as desired. For example, when included on a template, the threaded bit stop may engage a tab portion of the template below a support surface formed by the main body of the template 130. A nut 198 or the like may be included for ensuring that the bit stop 196 is not inadvertently adjusted.

Those of skill in the art will appreciate that the selection of mounting surface (e.g., the base, an extension on a template, a separate mounting, or the like) for the bit stop may depend on the type of joint to be formed. For example, in a half-blind dovetail the depth of the pins relative to the sockets may be varied. For example, a user may vary the depth to which material is removed from the two workpieces. This may be best exemplified by the case of a half-blind dovetail in which the pins/sockets are formed in a single operation. Considerations in the foregoing example include, but are not limited to the ability of the workpiece forming the sockets to hide the joint, the ability to assemble, form a sturdy joint (the ability of the pins to engage the sockets), and the like. The same considerations may apply for various other joints such as a tapered sliding dovetail or a sliding dovetail dado. In this instance, a bit stop may be mounted to the template as the selection of the extensions/sockets may be varied. In contrast, when cutting a through dovetail or a box joint which extends through the workpieces (i.e., is generally observable from two sides) the overall thickness of the workpieces may be taken into account when forming the joint. In consideration of this, an adjustable bit stop 101 for the pin/tails of a through dovetail system may be mounted to the base 102, such that the thickness of the workpieces may be taken into account (due to the spacing of the template away from the base substantially equal to the thickness one of the workpieces (typically the workpiece to include the pins)). For example, the position of the slots in the template and the location of the adjustable bit stop 101 on the base may permit a user to reverse the template such that the fingers or protrusions forming the respective guides (FIG. 9, tails 116 and pins 122) are positioned adjacent the first side of the base.

Referring to FIG. 17, a fixed position router bit stop is discussed. In the present embodiment, a series of fixed bit stop systems corresponding to a ½" (one-half inch) depth 107, a ⅜" (three-eighths inch) depth 109, and a ¼" (one-quarter inch) depth 111 are included with a single template 105. Including a fixed bit stop may allow a user to set the router bit depth to a pre-selected depth such as a commonly utilized depth. For example, when cutting a sliding tapered dovetail joint most woodworkers select either a ½" (one-half inch) joint, a ⅜" (three-eighths inch) joint, or a ¼" (one-quarter inch) joint to connect the workpieces. The bit stops may allow the user to quickly reference these router bit depths, or the extent to which a router extends beyond the base, in an efficient manner. In the present embodiment, the fixed stop is formed as a bracket coupled to the main body of the template via a fastener, disposed generally in-line with a slot included in the template. In further embodiments, a stop may be formed as a bent tab or the like coupled to a template, a base, a separate mounting or the like.

Figure 28A:
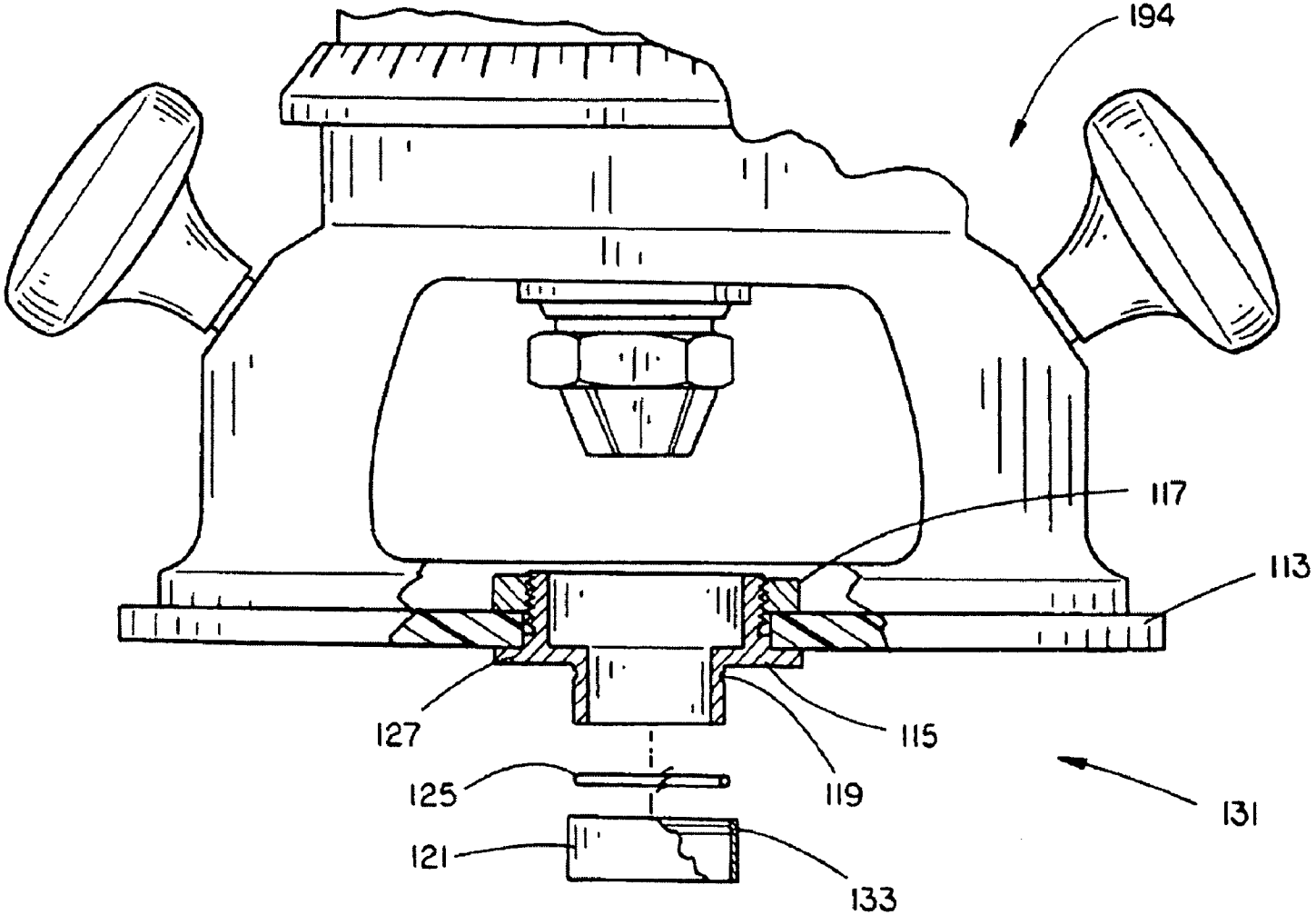
FIG. 28A is partial view of a router including an exemplary variable spacing collar system of the present invention.
Figure 28B:
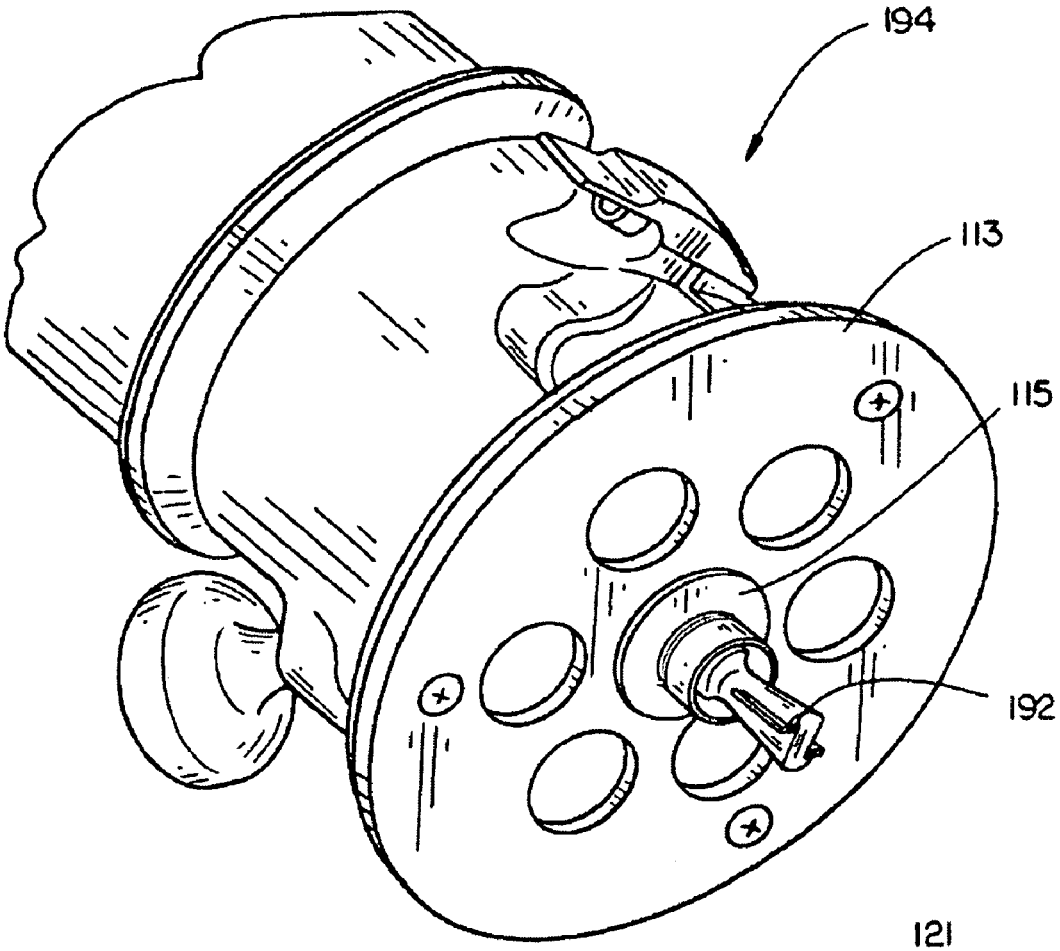
FIG. 28B is and exploded view of an exemplary variable spacing collar system.
Figure 29:
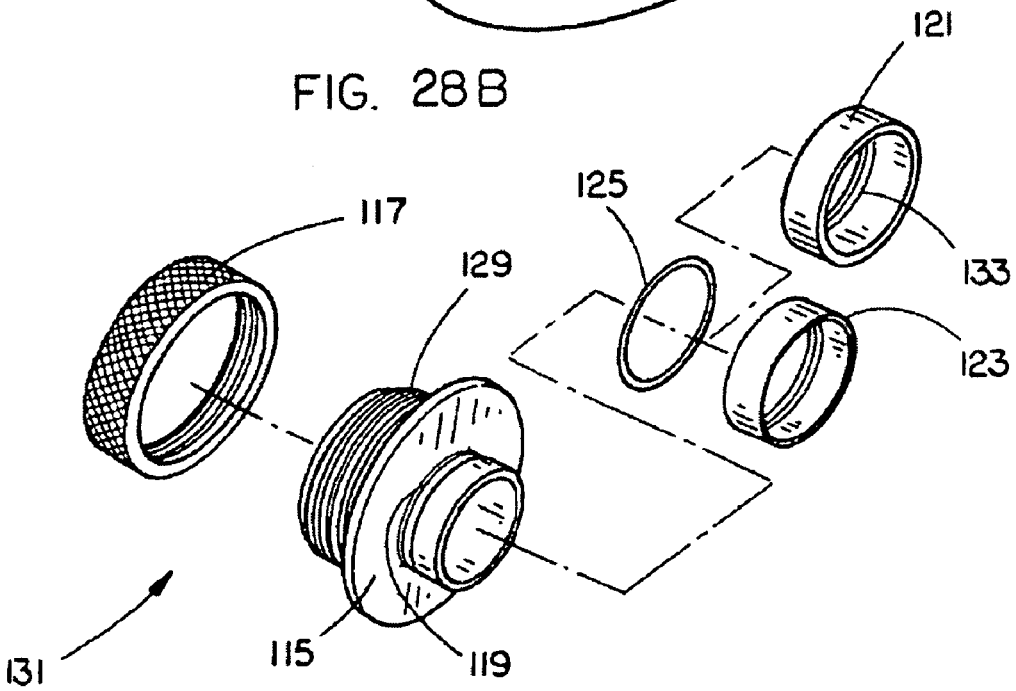
FIG. 29 is a cut-away view of a router including a variable spacing collar in accordance with an exemplary embodiment of the present invention.

Referring to FIGS. 28A, 28B, and 29, in a further aspect of the invention a variable spacing router collar system 131 is described. Those of skill in the art will appreciate that while the collar system of the present aspect is described for utilization for fashioning a mortise and tenon joint, the principles of the present invention may be suitable for forming inlays, use with various joint guides, user constructed guides, lettering guides, and the like for allowing variable spacing between a guide and a router bit. The variable spacing collar system includes a collar body 115 configured for being received by a router base or sub-base 113. For example, the collar body 115 is formed as a generally cylindrical sleeve having an outward extending flange 127 and a threaded end portion 129. The threaded end portion 129 may be engaged by a lock ring 117, having corresponding threading, for securing the collar system 131 to a router sub-base. In an advantageous example, the router sub-base/collar body are configured so the flange is substantially flush with or slightly recessed in the sub-base. A generally cylindrical outer sleeve 121 having a through aperture for being received about a portion of the collar body 115 may be secured via a frictional engagement, a magnetic engagement, or the like. For example, an O-ring 125 having a sufficiently high coefficient for retaining the outer sleeve during routing may be disposed between the outer surface of the collar body and the outer sleeve. Preferably, the O-ring 125 is retained in a groove 133 formed in the interior aperture of the outer sleeve 121. Retaining the O-ring in the outer sleeve 121 may prevent the O-ring from interfering with a collar body 115 tracing a template guide when the outer sleeve is disengaged. Additionally, a collar body groove 119 may be included to assist in aligning the outer sleeve 121 to the collar body 115. Those of skill in the art will appreciate, a kit of outer sleeves having different diameters and/or a kit of collar bodies having different diameters may be included for permitting variable spacing. For example, a first outer sleeve 123 having a first diameter may be included as part of a kit with a second sleeve 121 having a second outer diameter greater that the first diameter. In a further instance, a series of collar bodies having differing outer diameters may be implemented for a substantially similar purpose. In an advantageous embodiment, a variable spacing collar system includes a kit of collar bodies/outer sleeves corresponding to commonly formed mortise and tenon joints such as ½" (one-half inch) joint, a ⅜" (three-eighths inch) joint, or a ¼" (one-quarter inch). Additional collar bodies/outer sleeves having slightly larger/or smaller outer diameters may be included for permitting fine adjustment to permit formation of a joint or inlay having a tighter or looser fit. In a further embodiment, a master guide holder may be mounted to the router, such as flush with or interior to the base/sub base of the router (so as to not interfere with router operation when a guide is not attached), with guides for mortise and tenon formation being coupled via a threaded engagement, via a frictional engagement, via a magnetic interaction, or the like for retaining the guide to the guide holder with threading on the master guide which may permit an enlarged opening for dust/debris. In this manner, the individual guides may be removed without removing the master guide holder.

In an exemplary method for forming a mortise and tenon joint, a template defining the desired dimensions is configured. A first workpiece which is to be configured with a tongue, or male member, is formed utilizing a router with an attached collar body for following the template. A second workpiece which is to be configured with the mortise or female joint member is formed with a router with an attached collar body having an outer sleeve attached. The first and second workpieces are subsequently interconnected.

Figure 18:
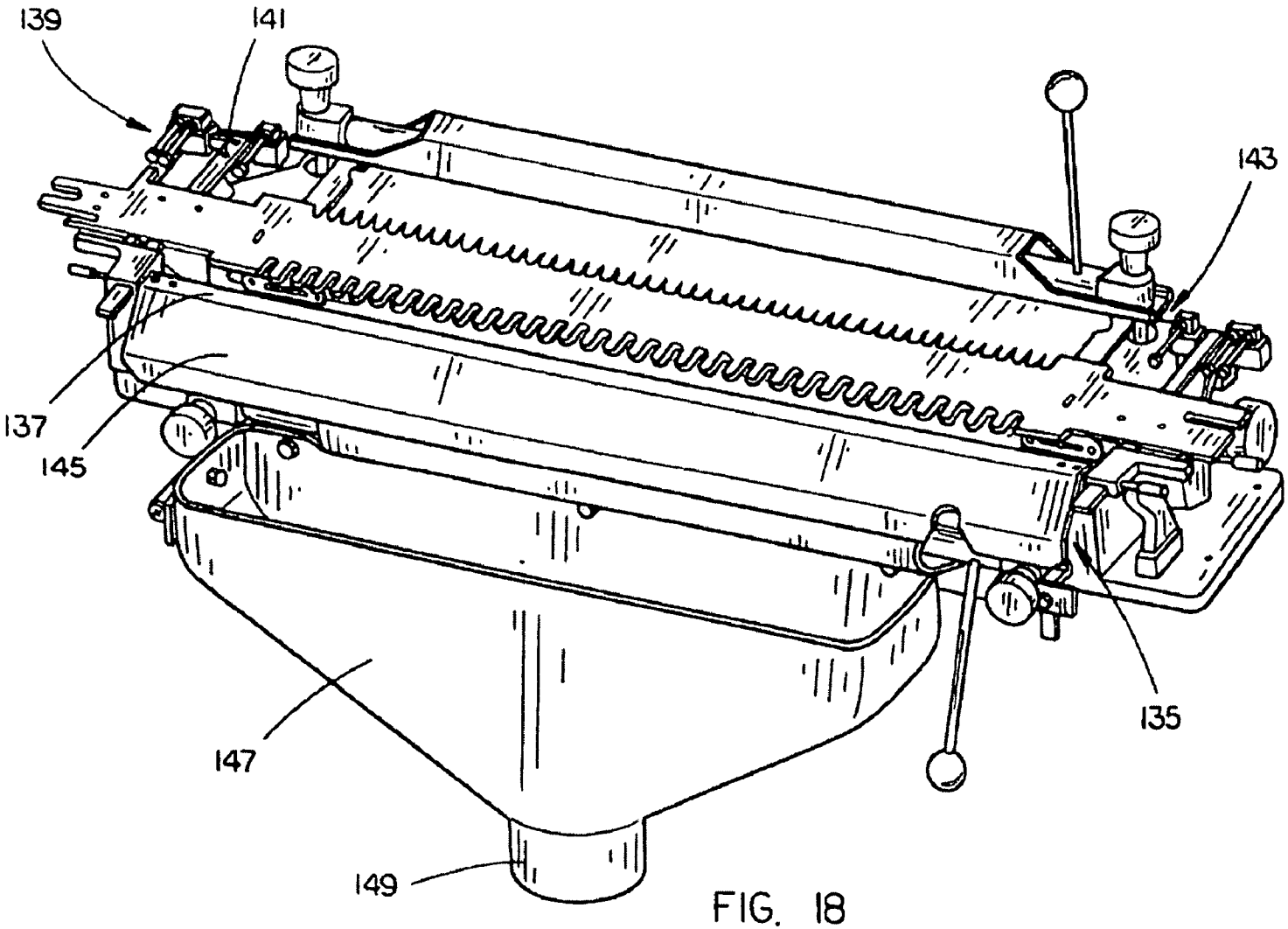
FIG. 18 is an isometric view of a jig apparatus including a router support and a dust collection chute in accordance with an embodiment.

Referring to FIG. 18, a router support 135 for implementation with a jig apparatus is disclosed. In the current embodiment, the router support is formed with a flat or planar rail portion 137 disposed substantially flush or equal to the surface of the template. Aligning the router support 135 substantially equal to the template may prevent tipping or tilting of the router bit during operation while providing a support surface for resting the router on during shaping operations, filling of the router/router bit as the router is manipulated by the guide may result in the joint being ill-filling. The router support in the current embodiment is mounted to the mounting rail 141 included in the template mounting bracket 139. In further embodiments, the router support may be mounted to the template, mounted to the base of a jig apparatus 100, and the like. A support brace extending the length of the router support 135 may be included for reinforcing housing portion 145. The housing portion 145 is formed with a curved or multisided portion directed generally toward the base. In this configuration, the housing portion 145 may direct dust and debris generated during material removal away from the template/router being manipulated adjacent the template when assembled to the jig apparatus 100. Additionally, the router support 135 may be utilized in conjunction with a dust collection chute 147 to collect dust and debris.

Figure 19:
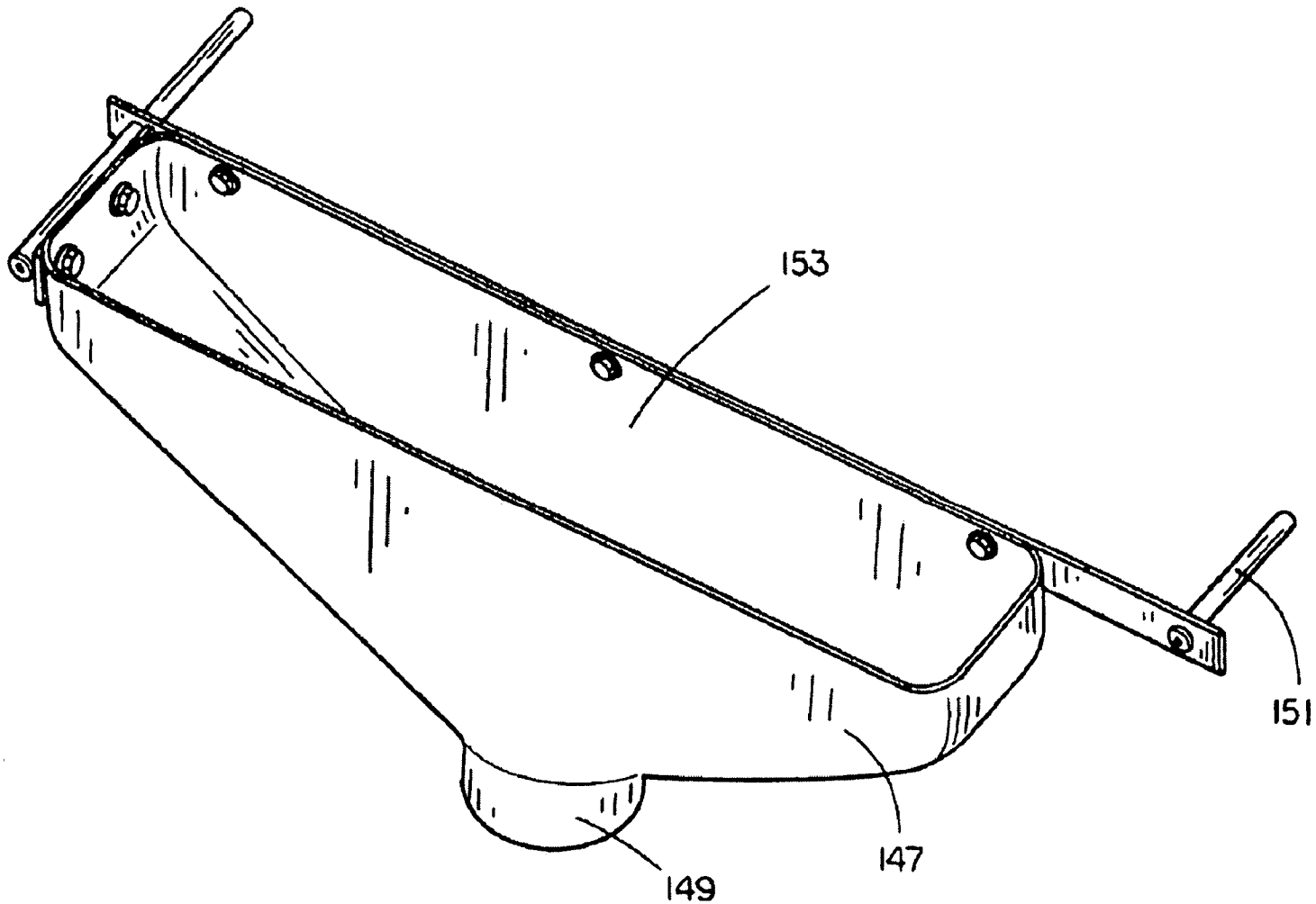
FIG. 19 is an isometric view of a dust collection chute in accordance with an exemplary embodiment of the present invention.

Referring to FIGS. 18 and 19, the dust collection chute 147 may be included as a removable accessory for the jig apparatus 100. Preferably, the chute opening 153 extends substantially along the first side 106 of the base 143 to direct dust and debris into a remote vacuum system coupled by a hose. The dust collection chute 147 includes a mounting mechanism for coupling the chute to the jig base 143. In the current embodiment, the dust collection chute includes a pair of spaced apart rods 151 (one is referenced) which are removably received in an aperture or recess included in the base. The rods may include threading for being secured via a nut disposed on an opposing side of the base 143. In further embodiments, various mounting mechanisms may be implemented such as a received rail system, a fastener system (e.g., a screw or bolt received in a threaded aperture in the base), an interlocking lip and support (such that the chute may hang from a support for efficient removal), and the like. An outlet flange 149 may be included for attaching a suitable connection hose or duct for transferring the dust/debris to a central vacuum system or a dedicated vacuum. In additional embodiments, a securing mechanism such as a deformable lab system, a friction lock or the like may be included on or adjacent the outlet flange 149 for securing a vacuum transfer hose to the chute.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A jig apparatus for use with a router to aid in the removal of material for forming an interconnection between workpieces, the jig apparatus comprising:

a base comprising a front side extending generally vertically, a top side extending generally horizontally, and a template mounting system, a template removably mounted to the template mounting system, the template comprising:

a plurality of guide fingers forming a top surface adapted to support a base of the router for movement relative to the template and a guide surface generally perpendicular to the top surface, the guide surface contacting a router guide to guide movement of the router relative to the template; and a dust collection chute removably coupled to the base, the chute comprising:

an intake opening extending at least partially along the front side of the base such that dust generated during material removal enters the chute through the intake opening, wherein the dust collection chute intake opening is positioned below the template, and an exit port spaced from the intake opening such that dust generated during material removal exits the chute through the exit port.

2. The jig apparatus of claim 1 wherein the dust collection chute is removably mounted to the front side of the base.

3. The jig apparatus of claim 1 wherein an axis of the dust collection chute exit port extends downward such that dust generated during material removal is directed to pass through the exit port at least partially by gravity.

4. The jig apparatus of claim 3 wherein the axis of the exit port extends downward at an angle greater than 20 degrees from horizontal.

5. The jig apparatus of claim 4 wherein the axis of the exit port extends downward at an angle greater than 45 degrees from horizontal.

6. The jig apparatus of claim 5 wherein an axis of the dust collection chute exit port extends vertically downward.

7. The jig apparatus of claim 1,wherein the base further comprises a removable router support, the router support comprising a top surface adapted to at least partially support the base of the router fur movement relative to the template, wherein the router support top surface is substantially coplanar with the template guide fingers top surface.

8. The jig apparatus of claim 7 wherein the dust collection chute is removably mounted to the router support.

9. The jig apparatus of claim 7 wherein the router support further comprises a bottom surface that is positioned above the dust collection chute intake opening such that the bottom surface of the router support directs dust generated during material removal into the intake opening.

10. The jig apparatus of claim 3 further comprising a vacuum system connected with the dust collection chute exit port.

11. A jig apparatus for use with a router to aid in the removal of material for forming an interconnection between workpieces, the jig apparatus comprising:

a base comprising a front side extending generally vertically, a top side extending generally horizontally, and a template mounting system;

a dust collection chute removably coupled to the base, the chute comprising:

an intake opening extending at least partially along the front side of the base such that dust generated during material removal enters the chute through the intake opening, wherein the dust collection chute intake opening is positioned below the template, and an exit port spaced from the intake opening such that dust generated dunng material removal exits the chute through the exit pan, wherein an axis of the exit port extends vertically downward at an angle greater than 20 degrees ham horizontal such tat that dust generated during material removal is directed to pass through the exit pan an least partially by gravity.

12. The jig apparatus of claim 11 wherein the axis of the exit port extends downward at an angle greater than 45 degrees from horizontal.

13. The jig apparatus of claim 12 wherein an axis of the dust collection chute exit port extends vertically downward.

14. The jig apparatus of claim 11 wherein the template comprises a plurality of guide fingers funning a top surface adapted to support a base of the router for movement relative to the template and a guide surface generally perpendicular to the top surface, the guide surface contacting a router guide to guide movement of the router relative to the template.

15. The jig apparatus of claim 11 wherein the dust collection chute is removably mounted to the front side of the base.

16. The jig apparatus of claim 11, wherein the base further comprises a removable router support, the router support comprising a top surface adapted to at least partially support the base of the router for movement relative to the template, wherein the router support top surface is substantially coplanar with the template guide fingers top surface.

17. The jig apparatus of claim 16 wherein the dust collection chute is removably mounted to the router support.

18. The jig apparatus of claim 16 wherein the router support furhter comprises a bottom surface that is positioned above the dust collection chute intake opening such that the bottom surface of the router support directs dust generated during material removal into the intake opening.

19. A jig apparatus for use with a router to aid in the removal of material fur forming an interconnection between workpieces, the jig apparatus comprising:

a base comprising a front side extending generally vertically, a top side extending generally horizontally, and a template mounting system;

a template removably attached to the template mounting system, the template comprising:

a plurality of laterally adjustable guide fingers forming a top surface adapted to support a base of the router for movement relative to the template and a guide surface generally perpendicular to the top surface, the guide surface contacting a router guide to guide movement of the router relative to the template; and a dust collection chute removably coupled to the base, the chute comprising:

an intake opening extending at least partially along the front side of the base such that dust generated during material removal enters the chute through the intake opening, wherein the dust collection chute intake opening is positioned below the template, and an exit port spaced from the intake opening such that dust generated during material removal exits the chute through the exit port, wherein an axis of the exit port extends vertically downward such that that dust generated during material removal is directed to pass through the exit port at least partially by gravity;

wherein, the base further comprises a removable router support, the router support comprising:

a top surface adapted to at least partially support the base of the router for movement relative to the template, wherein the router support top surface is substantially coplanar with the template guide fingers top surface, and a bottom surface that is positioned above the dust collection chute intake opening such that the bottom surface of the router support directs dust generated during material removal into the intake opening.

20. A jig apparatus for use with a router to aid in the removal of material for forming an interconnection between workpieces, the jig apparatus comprising:

a base comprising a front side extending generally vertically, a top side extending generally horizontally, and a template mounting system;

template removably mounted to the template mounting system, the template comprising:

a plurality of integrally formed guide fingers, the plurality of fingers forming a top surface adapted to support a base of the router for movement relative to the template and a guide surface generally perpendicular to the top surface, the guide surface contacting a router guide to guide movement of the router relative to the template; and a dust collection chute removably mounted to the front side of the base, the chute comprising:

an intake opening extending at least partially along the front side of the base such that dust generated during material removal enters the chute through the intake opening, wherein the dust collection chute intake opening is positioned below the template; and an exit port spaced from the intake opening such that dust generated during material removal exits the chute through the exit port, wherein an axis of the exit port extends downward at an angle greater than 20 degrees from horizontal such that that dust generated during material removal is directed to pass through the exit port at least partially by gravity.

21. The jig apparatus of claim 20 wherein the dust collection chute further comprises a fastener system connecting the chute with the front side of the base, the fastener system comprising a threaded bolt that passes through an aperture in the chute and is received in a threaded aperture in the base.

* * * * *

UNITED STATES PATENT AND TRADEMARK OFFICE

CERTIFICATE OF CORRECTION

PATENT NO. : 7,658,214 B2
APPLICATION NO. : 12/268091
DATED : February 9, 2010
INVENTOR(S) : Steven D. McDaniel It is certified that error appears in the above-identified patent and that said Letters Patent is hereby corrected as shown below:

Column 1, line 37, replace “lime” with -- time --.

Column 1, line 53, replace “obtained, for” with -- obtained. For --.

Column 2, line 2, replace “securing, for” with -- securing. For --.

Column 2, line 16, replace “manner, for” with -- manner. For --.

Column 2, line 52, replace “one” with -- zone --.

Column 3, line 43, replace “sub-basic” with -- sub-base -- and replace “slop” with -- stop --.

Column 4, line 40, replace “slop” with -- stop --.

Column 6, line 40, replace “lipped” with -- tipped --.

Column 7, line 41, replace “Mange” with -- flange --.

Column 7, line 54, replace “culling” with -- cutting --.

Column 8, line 8, replace “lime” with -- time -- and replace “lightened” with -- tightened --.

Column 9, line 64, replace “lightness” with -- tightness --.

Column 10, line 22, replace “shall” with -- shaft --.

Column 10, line 54, replace “an” with -- art --.

Column 11, line 49, replace “flush,” with -- flush --.

Column 12, line 28, replace “mechanism, for” with -- mechanism. For --.

Column 12, line 57, replace “line” with -- fine --.

Column 12, line 60, replace “slop” with -- stop --.

Column 13, line 19, replace “slop” with -- stop --.

Column 14, line 6, replace “adjustable, for” with -- adjustable. For --.

Column 14, line 33, replace “bracken” with -- bracket --.

Column 14, line 46, replace “of” with -- or --.

Column 15, line 2, replace “ail” with -- art --.

Column 17, line 56, replace “filling” with -- tilting --.

Column 17, line 57, replace “ill-filling” with -- ill-fitting --.

Column 18, line 25, replace “lab” with -- tab --.

Column 19, line 14 (claim 7, line 4), replace “fur” with -- for --.

Column 19, line 41 (claim 11, line 15), replace “dunng” with -- during --.

Column 19, line 42 (claim 11, line 16), replace “pan” with -- port --.

Column 19, line 44 (claim 11, line 18), replace “ham” with -- from -- and after “such” delete “tat”.

Column 19, line 46 (claim 11, line 20), replace “pan an” with -- port at --.

Column 19, line 53 (claim 14, line 2), replace “funning,” with -- forming --.

Column 20, line 2 (claim 18, line 2), replace “furhter” with -- further --.

Column 20, line 7 (claim 19, line 2), replace “fur” with -- for --.

Column 20, line 50 (claim 20, line 6), insert -- a -- in front of “template” at the beginning of the line.

Signed and Sealed this

Twentieth Day of April, 2010

David J. Kappos

David J. Kappos
*Director of the United States Patent and Trademark Office*